US011591751B2

(12) United States Patent
Lee

(10) Patent No.: US 11,591,751 B2
(45) Date of Patent: Feb. 28, 2023

(54) HIGH EFFICIENCY FIBER BLEACHING PROCESS

(71) Applicant: GPCP IP Holdings LLC, Atlanta, GA (US)

(72) Inventor: Jeffrey A. Lee, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 209 days.

(21) Appl. No.: 17/006,089

(22) Filed: Aug. 28, 2020

(65) Prior Publication Data

US 2021/0079594 A1 Mar. 18, 2021

Related U.S. Application Data

(60) Provisional application No. 62/901,288, filed on Sep. 17, 2019.

(51) Int. Cl.
*D21C 9/10* (2006.01)
*D21C 9/16* (2006.01)
*D21H 11/14* (2006.01)

(52) U.S. Cl.
CPC ..... *D21C 9/1057* (2013.01); *D21C 9/1063* (2013.01); *D21C 9/1084* (2013.01); *D21C 9/163* (2013.01); *D21H 11/14* (2013.01)

(58) Field of Classification Search
CPC ..... D21C 9/16; D21C 9/163; D21C 9/166; D21C 5/022
(Continued)

(56) References Cited

U.S. PATENT DOCUMENTS 2,514,503 A * 7/1950 McEwen ..... D21C 9/1047 162/69
3,462,344 A * 8/1969 Houg ..... D21C 9/1036 8/111
(Continued)

FOREIGN PATENT DOCUMENTS

EP 0187477 A1 7/1986
EP 0311356 A1 4/1989
(Continued)

OTHER PUBLICATIONS

Grace editor, Pulp and Paper Manufacture: Alkaline Pulping, 1989, The Joint Textbook Committee of the Paper Industry, vol. 5 3rd edition, p. 401 (Year: 1989).*
(Continued)

*Primary Examiner* — Anthony Calandra

(57) ABSTRACT

A high efficiency bleaching method for cellulosic pulp includes: (a) providing a charge of aqueous cellulosic pulp to a bleaching vessel at a consistency of from 10% to 30% along with a peroxy bleaching agent and an alkaline agent effective to adjust pH of the charge to 9.5 to 12.5; and (b) bleaching the aqueous cellulosic pulp in the bleaching vessel while maintaining a bleaching temperature of from 110° F. (43° C.) to 135° F. (57° C.) and a pH of the charge from 9.5 to 12.5 for an extended bleaching retention time. The bleaching method is advantageously used to bleach low brightness recycle pulp, and/or as part of a multistage process with bleaching stages of lesser duration, and/or as a high peroxy efficiency, low dose bleaching process or in connection with concurrently storing and bleaching pulp.

20 Claims, 12 Drawing Sheets

(58) Field of Classification Search
USPC ..... 162/78
See application file for complete search history.

(56) References Cited

U.S. PATENT DOCUMENTS

| | | | | |
|---|---|---|---|---|
| 3,655,505 | A | | 4/1972 | Yorston et al. |
| 3,811,995 | A | | 5/1974 | Ringley |
| 4,116,758 | A | | 9/1978 | Ford et al. |
| 4,295,929 | A | | 10/1981 | Leithem |
| 4,372,812 | A | | 2/1983 | Phillips et al. |
| 4,869,783 | A | | 9/1989 | Prusas |
| 4,871,423 | A | | 10/1989 | Grimsley et al. |
| 4,938,842 | A | | 7/1990 | Whiting et al. |
| 5,011,572 | A | | 4/1991 | Parthasarathy |
| 5,143,581 | A | | 9/1992 | Devic |
| 5,169,495 | A | * | 12/1992 | Lachenal ..... D21C 9/163 162/90 |
| 5,179,021 | A | | 1/1993 | Du et al. |
| 5,211,809 | A | | 5/1993 | Naddeo |
| 5,217,575 | A | | 6/1993 | Backlund |
| 5,486,268 | A | | 1/1996 | Nguyen |
| 5,503,709 | A | * | 4/1996 | Burton ..... D21C 9/16 162/190 |
| 5,958,179 | A | | 9/1999 | Selder |
| 5,997,689 | A | | 12/1999 | Bokstroem |
| 6,007,678 | A | | 12/1999 | Linsten et al. |
| 6,027,610 | A | | 2/2000 | Back et al. |
| 6,059,927 | A | | 5/2000 | Wan |
| 6,273,994 | B1 | | 8/2001 | Creber et al. |
| 6,632,328 | B2 | | 10/2003 | Wan |
| 9,556,558 | B2 | | 1/2017 | Pylkkanen et al. |
| 10,000,889 | B2 | | 6/2018 | Hart et al. |
| 10,000,890 | B2 | | 6/2018 | Nonni et al. |
| 2002/0012912 | A1 | | 1/2002 | Li et al. |
| 2004/0000012 | A1 | | 1/2004 | Scarpello et al. |
| 2008/0087390 | A1 | | 4/2008 | Lee et al. |
| 2009/0242152 | A1 | | 10/2009 | Vilpponen et al. |
| 2012/0067532 | A1 | | 3/2012 | Lee |
| 2013/0203699 | A1 | | 8/2013 | Nonni et al. |
| 2021/0079594 | A1 | | 3/2021 | Lee |

FOREIGN PATENT DOCUMENTS

| | | | | | |
|---|---|---|---|---|---|
| EP | 0480469 | A2 | | 4/1992 | |
| WO | WO-9508021 | A1 | * | 3/1995 | ..... D21C 9/1005 |
| WO | 9600322 | A1 | | 1/1996 | |
| WO | WO-2021123504 | A1 | * | 6/2021 | ..... D21C 5/005 |

OTHER PUBLICATIONS

Smook, Handbook for Pulp and Paper Technologists, 1992, Angus Wilde Publications, 2nd edition, chapter 11. (Year: 1992).*
Written Opinion of International Preliminary Examining Authority received for PCT Application No. PCT/IB2020/058139, dated Jun. 18, 2021, 07 Pages.
Search Report and Written Opinion dated Dec. 1, 2020.
International Preliminary Report on Patentability received for PCT Application No. PCT/IB2020/058139, dated Feb. 9, 2022, 8 pages.
International Search Report and Written Opinion received for PCT Application No. PCT/IB2021/062425, dated Mar. 29, 2022, 11 pages.

* cited by examiner (A) START (B) 4 HOURS PSV

HIGH EFFICIENCY FIBER BLEACHING PROCESS

CLAIM FOR PRIORITY

This application is based on U.S. Provisional Patent Application Ser. No. 62/901,288 filed Sep. 17, 2019, the priority of which is hereby claimed and the disclosure of which is incorporated herein by reference in its entirety.

TECHNICAL FIELD

The present invention relates to bleaching cellulosic pulps, especially bleaching wastepaper recycled pulp for manufacture of absorbent sheet such as tissue or towel products. The bleaching method includes a low temperature, extended duration bleaching stage which exhibits high brightness gains at low peroxy dosage. The process is advantageously integrated with multi-stage processes, or used to concurrently bleach and store pulp at a paper mill.

BACKGROUND

Bleaching cellulosic pulp in connection with papermaking processes is well-known in the art, since high brightness products are desirable, particularly for many absorbent products such as paper towel and paper tissue for the consumer market. U.S. Pat. No. 3,655,505 to Yorston et al. discloses a two-stage process for bleaching cellulosic pulp, including a first stage chlorine bleaching step followed by a peroxygen bleaching stage.

U.S. Pat. No. 4,938,842 to Whiting et al. discloses a process for bleaching cellulosic pulp at high consistency with hydrogen or sodium peroxide. The bleaching liquor is mixed with the pulp at low consistency, which is then thickened and bleached for a few hours, typically for 2 hours at a temperature of about 50° C. Col. 4 mentions prophetically conditions of consistency in the range of 20-70%, a temperature of from 10-90° C. for retention times of 1 minute to 24 hours, although actual retention times are lower.

U.S. Pat. No. 5,217,575 to Backlund discloses a process for oxygen bleaching cellulosic pulp using 2 vertical towers at superatmospheric pressure in the range of about 0.5 Mpa (72.5 psig). The temperature in each tower is from about 75° C. to about 105° C. for retention times of 15 minutes to 45 minutes in the towers.

United States Patent Application Publication No. US2008/0087390 of Lee et al. discloses a method of bleaching cellulosic pulp, including recycle pulp, comprising an activating step, an alkaline peroxide step and a reductive bleaching step. Typical conditions for each step are seen in Table 12, page 16. Alkaline peroxide bleaching may be carried out in the presence of oxygen (an "EOP" stage) at temperatures of 170° F. (77° C.) or so and the reductive bleaching step with hydrosulfite (a "Y" stage) may be carried out at similar temperatures. Retention times for each step are usually on the order of an hour or less.

United States Patent Application Publication No. US2009/0242152 of Vilpponen et al. discloses a two-stage bleaching process, including a chlorine dioxide ("DO") bleaching step, followed by an EOP bleaching stage, in many respects similar to the US2008/0087390 publication noted above.

Additional multi-stage bleaching processes for cellulosic pulp are disclosed in United States Patent Application Publication No. US2012/0067532 of Lee et al. The methods used alkaline hydroxide in combination with oxygen and peroxide in the initial bleaching stages, followed by treatment with a peroxide activating agent, followed by a final reductive bleaching stage.

United States Patent Application Publication No. US2013/0203699 of Nonni et al. discloses a method of bleaching cellulose pulp, including chemically modifying the fibers during the bleaching process by oxidizing the pulp under acidic conditions with a peroxide under acidic conditions with a catalyst during bleaching. The finished modified fibers are reported to be useful to inhibit the growth of microbes in finished paper products.

Applicant is aware that there may have been anecdotal verbal reports in the past about soaking towers used in Japan involving room temperature soaking of fiber for about a week. Such processes may or may not have utilized hydrogen peroxide in the towers, but Applicant is not aware of any specifics and was unable to confirm such reports.

Conventional bleaching processes are expensive in terms of operating and capital costs when trying to make high brightness pulp from recycled wastepaper, particularly when utilizing recycled paper of relatively low quality, which is becoming more prevalent in the marketplace, while supplies of higher quality recycled wastepaper are declining.

The availability of high quality recycled wastepaper has diminished in recent years, placing additional demands on bleaching operations to achieve high brightness. Traditionally high bright clean (HBC) types of wastepaper have been used to produce high quality and brightness recycled fiber. HBC includes printer waste (especially book printing waste), envelope cuttings, greeting card production waste and sorted office waste. These sources were primarily fully bleached Kraft fiber with only a small amount of low brightness contamination and were relatively easy to brighten to over 80 ISO brightness. As consumer habits shift away from printed items towards electronic books and communication the availability of HBC is diminishing, and the market price has increased. It is expected that these trends will continue and the supply of HBC will decrease to levels much lower than present supply levels.

Another factor diminishing the quality of HBC wastepaper is the promulgation of privacy laws which has driven an increase in shredding of office and home waste. The shredded paper has a lower quality because of damage to the fibers from the shredding process. At the same time, the shredded paper tends to a wider variability in quality and brightness than whole paper; shredded paper cannot be sorted to remove low quality materials, such as brown cardboard or newsprint.

Another significant change in the recycle paper raw material market is the growth in availability of mixed paper (MP). Mixed paper is paper material placed in recycling bins at homes and offices and is collected primarily by municipalities. Mixed paper contains a wide variety of paper materials including HBC, packaging, corrugated and unbleached Kraft fiber, newsprint and a significant amount of non-paper contaminants such as glass, metal and plastics. For the most part, MP is recycled into pulp for low quality and low brightness packaging materials and at one time there was a significant global demand. The demand for MP has diminished well below the supply and much of this material is currently landfilled at great expense. The cost of MP is expected to remain significantly below HBC due to its low brightness and lack of technology to produce a high brightness recycled fiber.

Integrated recycling mills routinely store finished fiber in significant quantity between the recycling system and the paper machines. Both of these processes are complicated and take significant time and effort to start up, shut down and adjust production quality. Storage is a means to allow sufficient buffer for grade changes and maintenance. Unfortunately, stock storage, especially recycled fiber storage, has the potential for a number of undesirable outcomes. The primary risk is degradation of the fiber due to biological growth. Biological growth can reduce the fiber brightness, cause odor issues and cause paper machine losses due to sheet breaks from slimes and biological residues. Biocide programs can somewhat mitigate growth, but these programs are expensive and have efficacy for limited retention times.

SUMMARY OF INVENTION

The present invention provides a methodology to produce high brightness pulps from low brightness recycle paper at relatively low cost, the invention processes having extremely high levels of bleaching efficiency, low peroxide consumption and high brightness gains. The invention provides a peroxy bleaching method for cellulosic fiber, referred to sometimes herein as pulp. A preferred set of ranges for operating parameters for high efficiency bleaching include:

Temperature: From 110-135° F. (43-57° C.), typically about 125° F. (52° C.);

Retention time: From 6-90 hours, typically about 15 hours;

pH: From 9.5-12.5, typically from 10-11;

Consistency: From 10-30%, typically about 15%.

One preferred implementation of the process is in connection with a multi-stage process for bleaching recycle pulp of relatively low brightness, including one or more bleaching stages of lesser duration, as is seen in FIG. 1 which is a histogram of brightness gain comparing a conventional 2-stage process with 2 and 3-stage bleaching processes of the invention. Further features are shown in FIG. 2. For simplicity, the method of the invention is referred to as Psv bleaching. A two-stage sequence Psv/Y is the most basic application. Three stages of bleaching would use optimally a Psv/P/Y sequence or a Psv/EOP/Y sequence. A somewhat less advantageous three-stage sequence would be Psv/Y/P. A Psv stage is best used as a first bleaching stage due to its low temperature. If it was used after a conventional bleaching stage the pulp would have to be cooled down which is expensive and technically difficult.

A Psv stage is also a better first stage because of its high chemical efficiency as is appreciated from FIG. 3, wherein it is seen that the high efficiency bleaching process of the invention exhibits bleaching efficiencies up to about twice that seen in conventional processes.

Another preferred implementation is to concurrently bleach and store pulp, optionally at somewhat lower temperatures and for even longer duration, since it has been found that pulp does not yellow at lower temperatures as is seen in FIG. 2. Moreover, microbial growth is inhibited at high pH and in the presence of peroxy compounds which are biocides. This aspect of the invention ameliorates a significant storage problem at a paper mill, where microbial growth in stored pulp is oftentimes exceedingly persistent and difficult to control, leading to off-spec product and papermachine shut-downs. The invention may be used to convert an existing bleaching operation simply by using a storage tower to conduct Psv bleaching.

A particularly surprising aspect of the invention is that the brown color in recycle pulp due to the presence of fiber from recycled corrugated products is removed, even though Kappa numbers remain significant. Conventional wisdom is that an oxygen (EO) stage is needed to eliminate the brown color in recycle furnish. The invention eliminates or reduces the need for pressurized bleaching, greatly reducing capital and operating costs when processing low quality recycled fiber (cellulosic pulp) to high brightness.

The invention thus addresses many long felt needs in the industry and allows for the use of relatively low brightness recycle pulp which is increasingly available at relatively low cost.

Further advantages and features of the invention are appreciated from the following description and appended drawings.

BRIEF DESCRIPTION OF DRAWINGS

The invention is described in detail below with reference to the drawings wherein like numerals designate similar parts and wherein.

DETAILED DESCRIPTION

Figure 1:
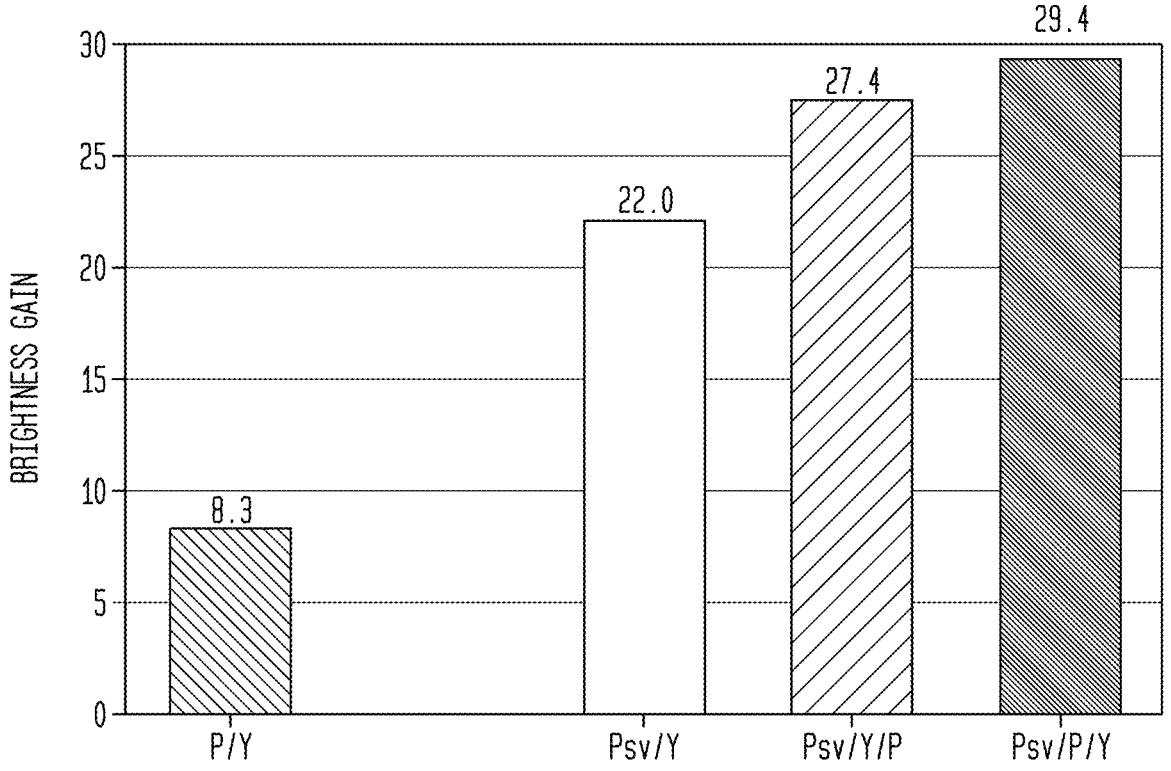
FIG. 1 is a histogram of brightness gain comparing a two-stage conventional P/Y process with multi-stage Psv/Y, Psv/Y/P and Psv/P/Y processes of the present invention.

The invention is described in detail below in connection with the Figures for purposes of illustration only. The invention is defined in the appended claims. Unless otherwise indicated, terminology used herein is given its ordinary meaning consistent with the exemplary definitions set forth immediately below; g, or G refers to grams, MT means metric ton, percents, ppm and like terminology relates to weight percent, parts per million by weight unless otherwise indicated and so forth.

An alkaline agent means a compound used to adjust the pH of the bleaching liquor to relatively high values. Hydroxides such as caustic, sodium hydroxide are preferred.

Bleaching temperature and like terminology refers to the temperature maintained in a bleaching stage or a vessel over the retention time of bleaching, and may be referred to as retention temperature.

"ISO brightness" or simply brightness as used herein refers to the measured brightness of the pulp made into handsheets in accordance with TAPPI Test Method T 525 om-17 or equivalent, with C-illumination. Diffuse reflectance is measured in the wavelength range of 400-520 nm with an effective wavelength of 457 nm by using a suitable filter set or an equivalent device for modifying the spectral response and an instrument having diffuse illumination and perpendicular observation geometry. The measurements are made in terms of absolute reflectance factors. Brightness testing is done on handsheets using a MacBeth Ci5 instrument. Brightness gain is expressed as a percentage relative to the brightness of the pulp prior to bleaching.

"Chemical wash", "wash" or like terminology refers to a washing step with water to remove chemicals and bleaching residues from the pulp. A washing step is usually advisable following a peroxy bleaching step, before a subsequent stage, and is usually required between peroxy bleaching steps to optimize results. In the experimental section, a wash is provided between bleaching stages unless otherwise indicated.

"Consisting essentially of" and like terminology refers to the recited components and excludes other ingredients which would substantially change the basic and novel characteristics of the composition, article or process. Unless otherwise indicated or readily apparent, a composition or article consists essentially of the recited or listed components when the composition or article includes 90% or more by weight of the recited or listed components, optionally on a dry basis, that is, without water. The terminology excludes more than 10% unrecited components.

Consistency refers to percent solids of a pulp slurry calculated on a dry basis. A slurry having 80 percent water and 20 percent dry pulp has a consistency of 20 percent. Unless otherwise indicated, dry pulp, dried pulp and like terminology means oven dry pulp, which may have up to a few percent water.

A Kappa number is determined in accordance with TAPPI Method T236-0M-99P. The Kappa number is the volume (in millimeters) of 0.1N potassium permanganate solution consumed by one gram of moisture-free pulp. The results are corrected to 50% consumption of the permanganate added. Kappa numbers are commonly used to determine lignin content and used to determine bleachability of pulp.

"Percent on pulp" "OP" and like terminology refers to the weight ratio of a hydrogen peroxide/dried pulp×100% in a charge to a bleaching stage.

"Percent consumed on pulp" and like terminology refers to the weight ratio of hydrogen peroxide actually consumed in a bleaching stage/dried pulp content in the charge to the bleaching stage×100%.

Percent on pulp, OP, "Percent consumed on pulp" may likewise be expressed for hydrogen peroxide and other peroxy bleaching agents as kg-moles/metric ton of dried pulp, it being noted that 1% OP or 1% Percent consumed on pulp corresponds to 0.295 kg-moles bleaching agent/metric ton of dried pulp.

A bleaching "stage" refers to bleaching pulp in a vessel under a specified set of bleaching conditions. Subsequent stages may be undertaken in the same vessel for batch or semi-batch processes and in downstream vessels for continuous processes.

"Peroxy compound" and like terminology refers to compounds having a peroxo group. Typically one employs hydrogen peroxide in the bleaching method of the invention; however, one may utilize other peroxy compounds as a bleaching agent if so desired. Other suitable peroxy bleaching compounds include peroxyacetic acid, peroxyformic acid, potassium peroxymonosulfate, dimethydioxirane, peroxymonophosphoric acid and so forth.

A "reductive bleaching agent" refers to a reducing agent used to bleach pulp. Commercial systems may employ a mix of sodium borohydride and sodium bisulfite that form sodium hydrosulfite either in situ with the pulp or in a mixing step prior to addition to a reductive bleaching stage. Alternatively, sodium hydrosulfite as such may be used as available. These bleaching agents and equivalents are referred to as hydrosulfite bleaching agents. Additional reductive bleaching agents which may be used include formamidine sulfinic acid (FAS) and hydroxymethane sulfinic acid (HAS).

"Retention time" and like terminology refers to the duration of bleaching under a specified set of conditions in a bleaching stage. Temperatures, retention temperatures and the like refer to temperatures maintained during the retention time in a bleaching vessel.

Conventional pulp bleaching stages are commonly referred to as Y stages, EO stages, EOP stages or P stages.

A "Y" stage refers to a reductive bleaching stage utilizing a reductive bleaching agent; an "EO" stage refers to an alkaline, oxygen based bleaching stage carried out under oxygen pressure of from 0.25 to 1 Mpa in most cases; an "EOP" stage refers to an EO stage with a peroxy bleaching agent present and a "P" stage refers to a conventional alkaline peroxy bleaching stage. Representative operating parameters for a P stage appear in Table 1.

TABLE 1

Operating Parameters for P Stage bleaching

| Peroxide % OP | NaOH % OP | Temperature ° F./° C. | Retention Minutes |
|---|---|---|---|
| 1% | 1% | 185/85 | 60 |
| 3% | 3% | 185/85 | 60 |

Each of these conventional bleaching processes is carried out for a retention time of from about 5 minutes to about 3.5 hours, typically from 10 minutes to 2.5 hours of retention time and in many cases for a retention time of from 15 minutes to 1 hour. These processes are likewise carried out at relatively elevated temperatures, generally from 50° C. to about 150° C., with from 65° C. to about 125° C. being typical. Bleaching at over 100° C. requires a pressurized reactor, which involves high capital costs. Avoiding a pressurized reactor for oxygen or high temperatures is a significant advantage of the present invention.

Figure 2:
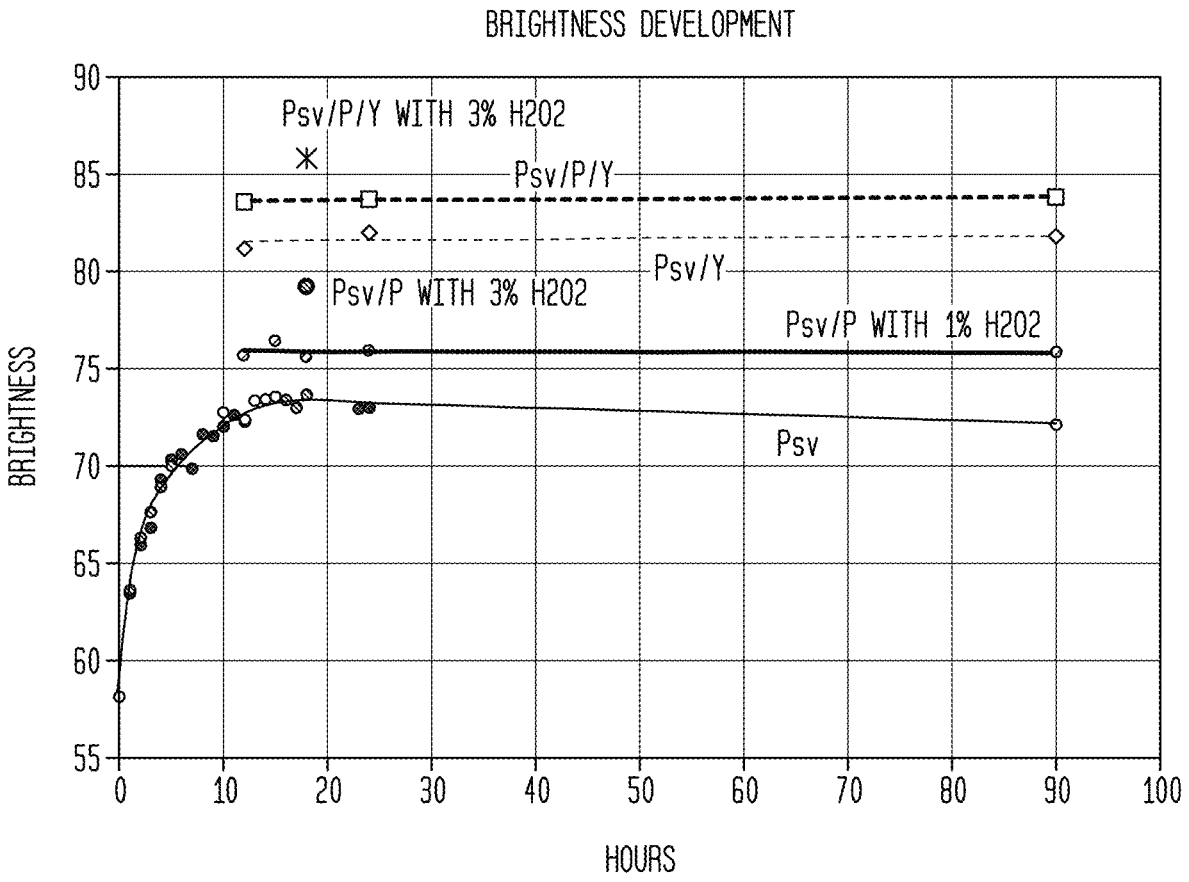
FIG. 2 is a plot of brightness versus time for recycle pulp bleaching with various processes of the present invention.
Figure 3:
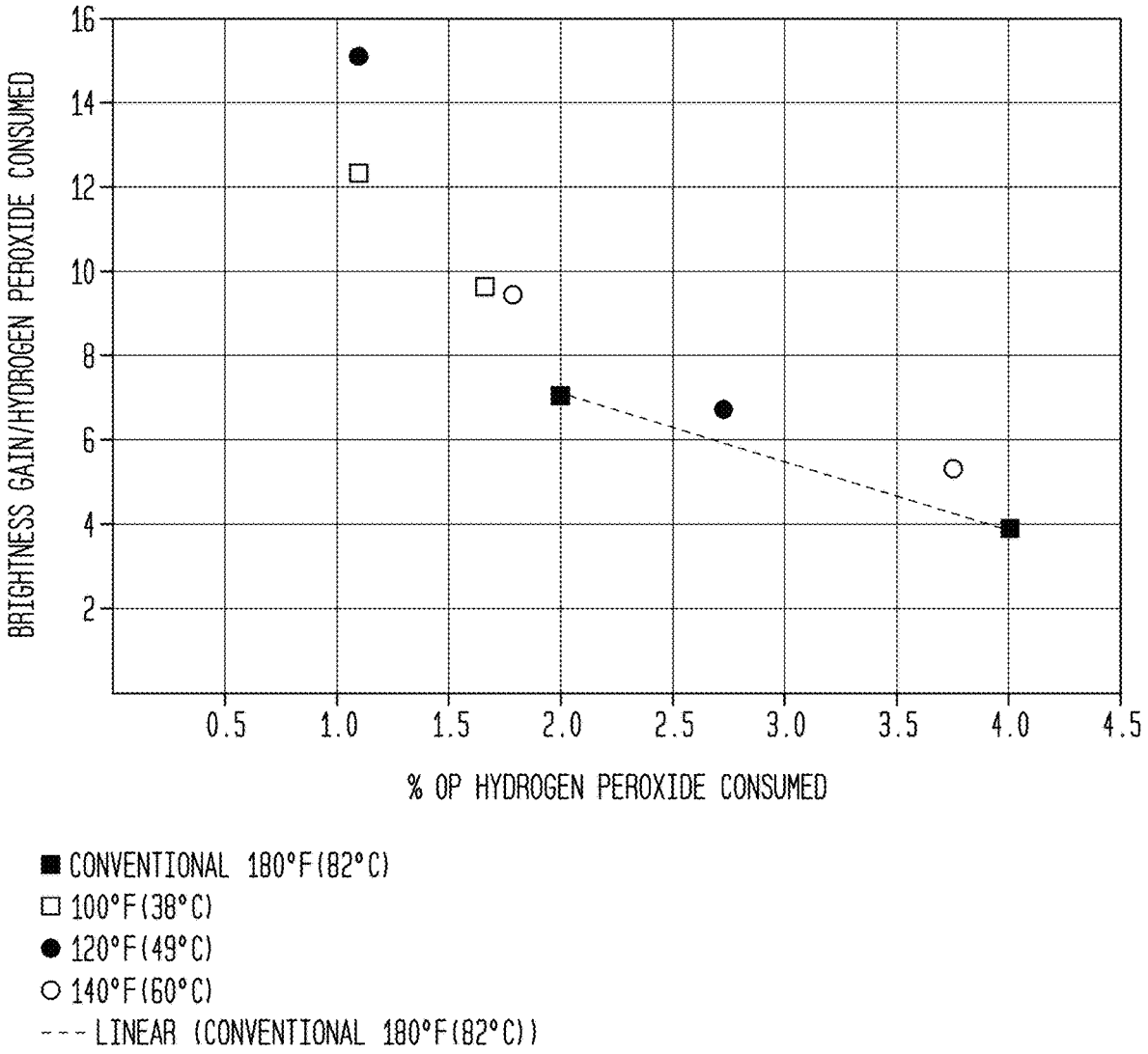
FIG. 3 is a plot of brightness gain divided by hydrogen peroxide consumption versus hydrogen peroxide consumption for extended duration recycle pulp bleaching in accordance with the invention and conventional bleaching.

It is appreciated from FIGS. 1-3 and the discussion which follows that:

1. Low temperature/extended retention bleaching, Psv, may negate the need for an oxygen stage to process mixed recycle paper;

2. Psv allows a 2 or 3 stage bleaching sequence to deliver up to 25-30 points of brightness gain;

3. Psv has the highest chemical efficiency/lowest chemical cost of any hydrogen peroxide process currently known; and 4. The Psv process eliminates biological degradation in extended stock storage and is readily incorporated into existing bleaching plants at paper mills with minimal capital investment.

Preliminary Trials

A blend of 80% SOP (sorted office pack waste) and 20% mixed paper was prepared and used for pulp production. The mixed paper was hand sorted into blend of ⅓ old corrugated (OCC), ⅓ news type paper and ⅓ white type paper. Non-paper contaminants were removed and not included in the blend i.e. the 20% weight fraction of the mix. The 80/20 blend was then pulped, screened, washed, kneaded and disk dispersed and a fully deinked pulp sample produced for bleaching experiments, described below.

Figure 4:
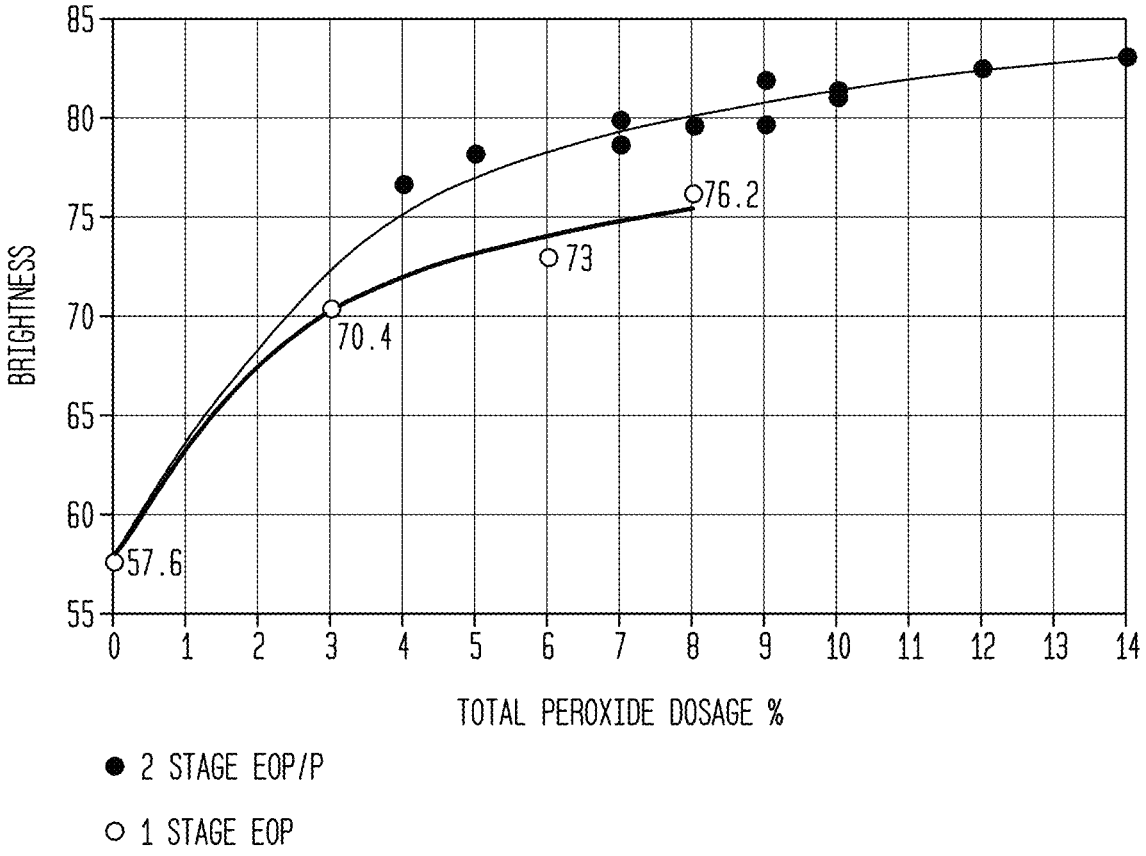
FIG. 4 is a plot of brightness versus peroxide dosage for single-stage EOP and two-stage EOP/P bleaching.

This pulp was bleached with conventional conditions using single-stage alkaline oxygen peroxide (EOP) and two-stage EOP/P bleach sequence (alkaline oxygen peroxide→chemical wash→alkaline peroxide). The bleaching was done in a Quantum mixer. All EOP stages were done at 12% consistency for 60 minutes at 82° C. temperature. The P stages increased the retention time to 120 minutes. The EOP stages were done a 60 PSIG (0.414 MPa) charge of oxygen at the beginning of the retention and the oxygen vented and recharged at 15 minutes. The two charges amount to approximately 1% oxygen on oven dry (OD) fiber on a weight basis; the actual consumption of oxygen is significantly less but was not measured. The P stages were done at atmospheric pressure in the Quantum mixer. The initial pulp had a 57.6 ISO brightness. Single-stage EOP increased this to 70.4-76.2 with a 3% to 8% on pulp (OP) hydrogen peroxide charge. The alkali, NaOH was added at a 1:1 ratio with the hydrogen peroxide. Two-stage EOP/P increased the brightness to 76-83 with a total hydrogen peroxide charge between 4 and 14% OP. FIG. 4 shows a typical technology curve for bleaching with single-stage EOP (alkaline oxygen peroxide) and two-stage EOP/P (EOP followed by alkaline peroxide). The curve shows the well known high initial brightness response followed by a flattening as the chemical dose is increased. The curve also shows two-stage bleaching delivers a higher brightness than single-stage bleaching at any given chemical dose.

For the next set of experiments a two-stage sequence was utilized. Instead of an EOP stage as the first stage, an EO stage was used as a first stage, i.e., without hydrogen peroxide. This was based, in part, on the discovery that alkaline darkening in a first stage could be recovered in a subsequent alkaline peroxide stage. Additionally, hydrogen peroxide cost is reduced.

The first stage was an EO stage under similar conditions as the EOP above but at 85° C. and without any hydrogen peroxide. The NaOH dose was 4% OP. Mixed paper contains significant unbleached Kraft fiber that is dark brown in color and contains significant lignin. Oxygen is added in the EOP stage to help decolorize the brown fibers. Experience has been that an alkaline peroxide stage will not effectively decolorize brown fibers which are readily observed in a finished pulp. The experiment with an EO stage was intended to determine if it was possible to decolorize brown fibers under mild conditions. Kraft mills often use 2× to 3× the NaOH dose in similar stages. In this experiment the EO stage did not significantly decolorize the brown fibers and only resulted in a 59.2 brightness (1.6 ISO gain). The next experiment was to do a conventional, high temperature, peroxide (P) stage on the EO fiber to compare to the results above. The stage was run at 85° C., 2 hours retention. Two runs were made with 2% hydrogen peroxide+1.5% NaOH and 4% hydrogen peroxide with 3% NaOH OP. The brightness after EO/P was 72.2 ISO for 2% $H_2O_2$ and 73.4 4 ISO for 4% H2O2. While the gain with 4% $H_2O_2$ is not much better than 2%, the 2% brightness was significantly higher than both the EOP and EOP/P sequences with similar or even higher peroxide doses. The brown fiber also surprisingly decolorized in the P stage contrary to conventional wisdom that oxygen is required for a P stage to decolorize unbleached Kraft fiber.

Figure 5A:
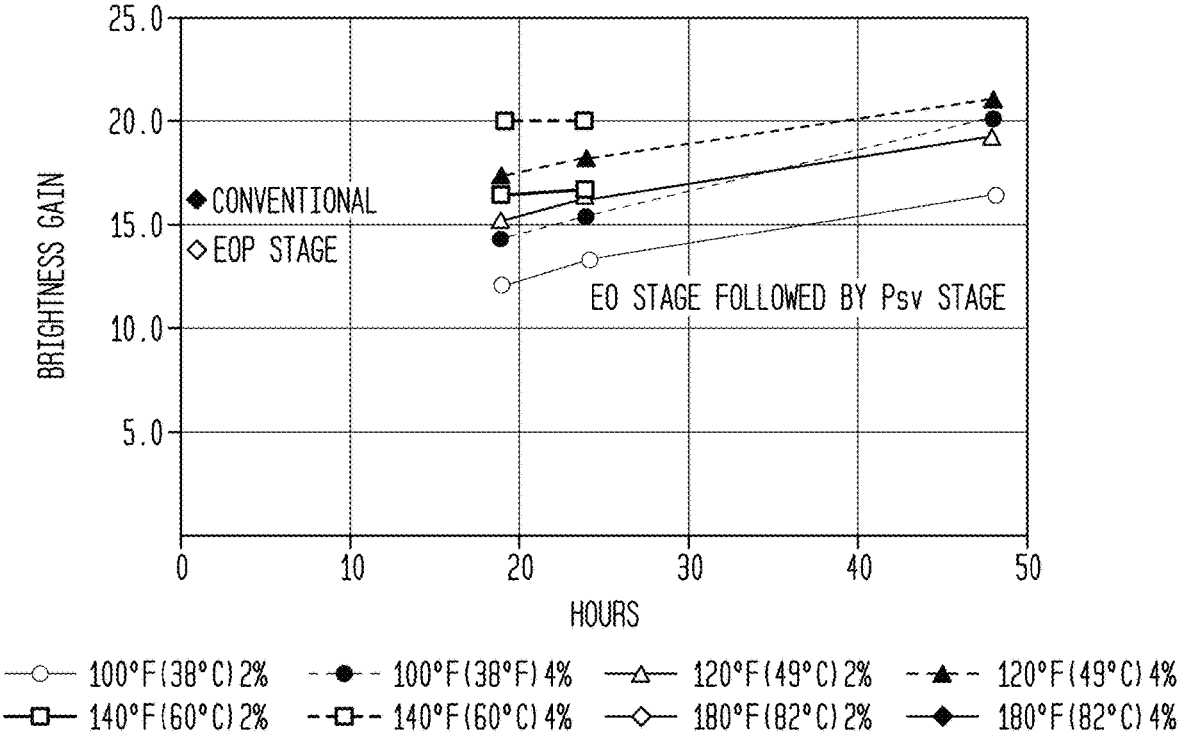
FIG. 5A is a plot of brightness gain versus time for various bleaching processes of the invention and conventional processes.
Figure 5B:
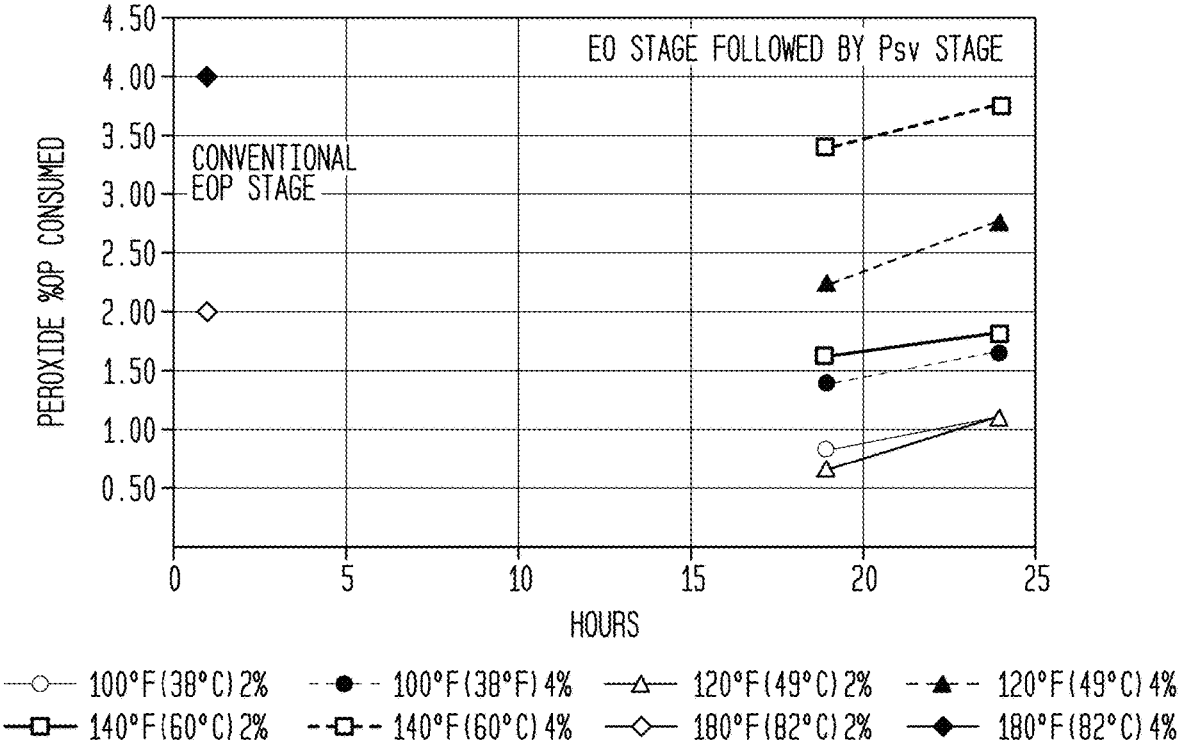
FIG. 5B is a plot of peroxide consumption versus time for the processes illustrated in FIG. 5A.

The pulp from the EO stage was next bleached under low temperature and extended reaction conditions. The EO pulps were bleached using a matrix of 2% and 4% OP hydrogen peroxide and 100° F. (37.8° C.), 120° F. (48.9° C.) and 140° F. (60° C.) reaction temperature. The brightness development was monitored at intervals between 19 and 48 hours. Reaction was stopped once the hydrogen peroxide exceeded 95% consumed (on the basis that once the peroxide is consumed no further brightness can be gained). The brightness development curves for the various trials are summarized in FIGS. 5A and 5B. FIG. 5A plots the brightness gains for the various temperatures and chemical doses (% $H_2O_2$ on pulp) at 19 hours, 24 hours, and 44 hours. FIG. 5B shows the measured hydrogen peroxide consumed at 19 and 24 hours. The data also includes the same pulp bleached at 180° F. (82.2° C.) in a conventional EOP stage with similar chemical doses. The conventional EOP stages consumed 100% of the peroxide charge—there was only a trace of residual at the end of the retention time.

Considering the data, it was seen that:

1) All of the low temperature cells surpassed the control brightness gains given sufficient retention time.
2) All of the low temperature cells consumed significantly less hydrogen peroxide than the controls.
3) The 140° F. (60° C.) samples had a (high) peroxide consumption similar to the controls but achieved a higher brightness.

Generally, increasing the peroxide dose resulted in a higher gain and/or a faster arrival at maximum brightness gain. The 140° F. (60° C.) sample seems to be on a different reaction curve than the other samples. The 100° F./2% peroxide (37.8° C./2% peroxide) cell, while achieving both a higher brightness and a higher chemical efficiency than the control, showed the lowest brightness gain. Interestingly, the 100° F./4% peroxide (37.8° C./4% peroxide) cell had both a competitive brightness gain and a very high chemical efficiency. Overall the 120° F. (48.9° C.) cells had both high total brightness gain and very high chemical efficiencies.

The next series of preliminary trials was to complete a series of "conventional" bleaches on the EO/Psv pulp. The 24 hour and the 48 hour samples were bleached along with the EO controls. All pulps were bleached using 2% $H_2O_2$ and 1.2% NaOH along with 0.5% sodium silicate as a stabilizer. Conditions were 180° F. (82.2° C.) and 2 hours retention. Next the pulps were bleached with sodium hydrosulfite (Y) and then given the final wash (the pilot plant process includes a final deinking and washing stage after the bleaching).

Figure 6:
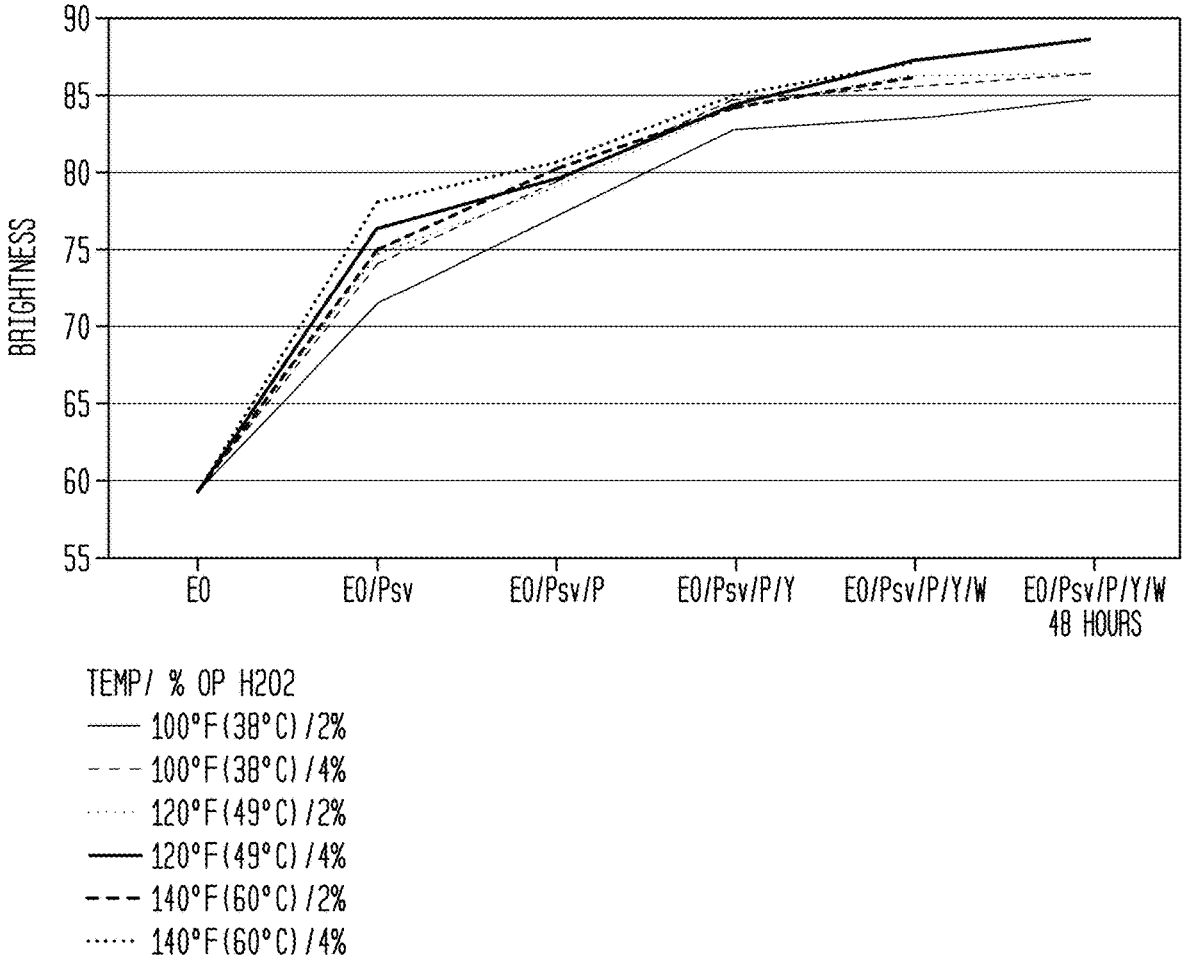
FIG. 6 is a plot of brightness versus sequential bleaching processes of the invention for recycle pulp and a single-stage conventional EO bleaching stage.

The brightness at each stage is shown in FIG. 6. The Figure has the complete sequences for the 24 hour Psv samples. It also includes the final results for pulps retained for 48 hours in the Psv stage. The Figure shows the peroxide containing stage, Psv, delivers the most significant brightness gain. Second and third stages increase the final brightness with diminishing gains. The 100/2 (37.8° C./2% peroxide) sample has a consistently lower brightness throughout. The 100/4 (37.8° C./4%) is more competitive and points to the potential gain from higher chemical concentration; the peroxide consumption is similar for both samples. FIG. 6 also shows the brightnesses converging towards 85-87 brightness regardless of the chemical dose and temperature.

The Psv samples with 48 hours of retention show an average brightness about 1 point above the 24 hour samples; doubling the retention in the Psv resulted in a brightness increase for all the samples. This confirms that using an HD storage tower as a bleaching stage will mitigate biological concerns, instead of just using the tower for storage.

Additional Trials

Additional trials were done to explore the Psv stage as a first bleaching stage and whether the invention process could be run commercially without any oxygen stage. Oxygen bleaching requires a large capital investment because a pressurized reaction vessel is required. So while oxygen gives many advantages, especially decolorization of brown fibers, it also entails a very high capital cost. Pressurized oxygen stages are also more difficult to commercially operate because of the requirement to control pressure. Running a high temperature EO or EOP as a first stage makes it difficult to achieve a target Psv temperature of 120-130° F. (48.9-54.4° C.)—water chilling may be necessary. This would especially be difficult in summer months and Southern mills.

A high temperature 2nd stage improves the robustness of the system. Variation in the long Psv stage can be mitigated by varying the conditions in the high temperature second peroxide stage. For example, in short Psv retention situations the additional peroxide could be added to compensate for lower Psv brightness. Alternatively, if the Psv brightness is very high the second P stage could be skipped altogether.

In any event, Psv as a first stage would be a lower capital upgrade; the existing EOP/Y bleach plants could be left essentially intact.

It was postulated that Psv would decolorize brown fibers without the use of oxygen. This was later confirmed and provides a very low capital upgrade to a non EOP bleaching system.

The 80/20 SOP/mixed pulp (unbleached stock) was Psv bleached in the water bath at 50° C./122° F., 6.4% consistency and 24 hours retention. A matrix of 6 chemical doses was set up with $H_2O_2$/NaOH % OP doses of 2/2, 4/2, 2/4, 4/4 and 6/4. After 24 hours, samples were tested and gently washed on a Buchner funnel to prepare for the next bleaching stages.

Figure 7:
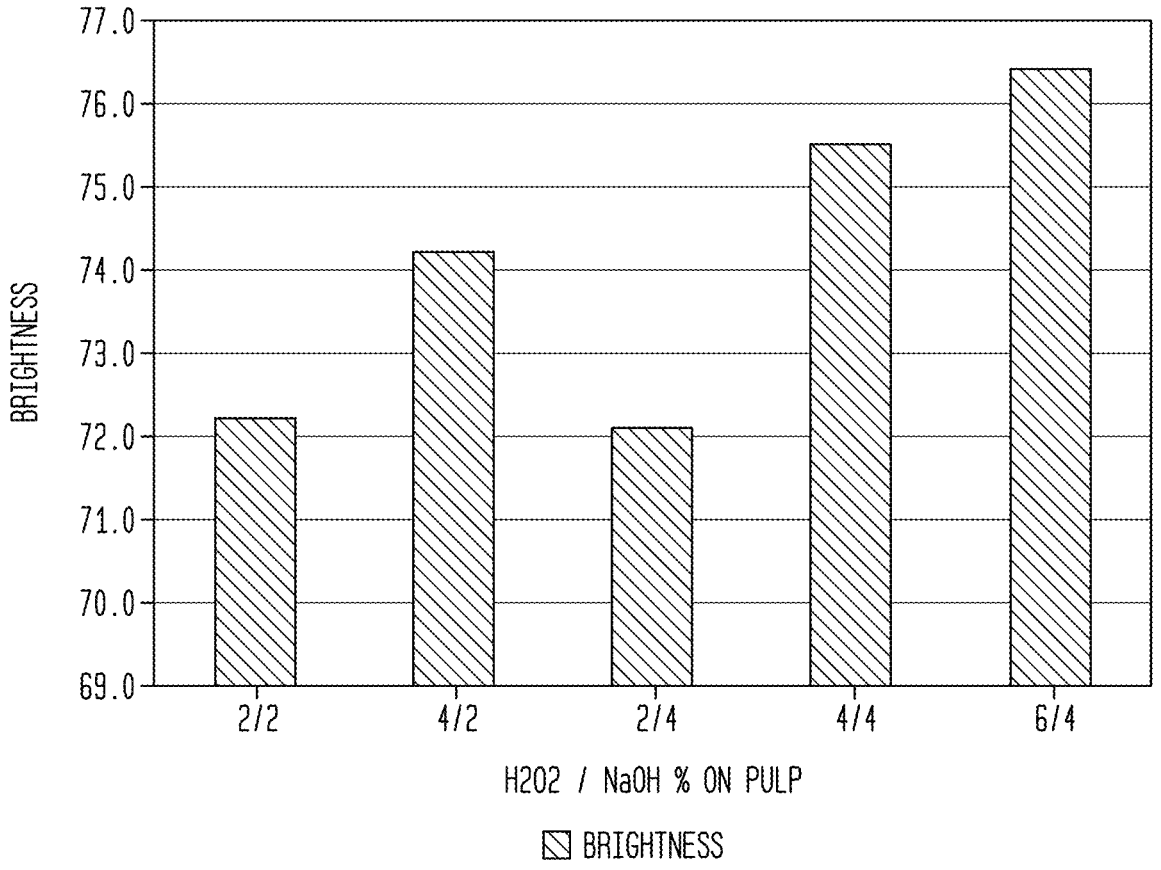
FIG. 7 is a histogram of brightness versus applied hydrogen peroxide and caustic for various processes of the invention.

The brightness gains for Psv as a first bleaching stage are given in FIG. 7. The brightness gain ran between 14 and 18 with an average of 16 points. The brightness gain is fairly independent of the caustic dose. The gain does increase marginally with the peroxide dose. This is an extraordinarily high brightness gain for the chemicals and conditions employed; current commercial peroxide stages typically exhibit 3-8 percentage points of brightness gain.

The pulps also showed a surprising and unexpected decolorization of the brown OCC fiber (old corrugated containers).

The washed Psv pulps were subjected to a range of non-oxygen (i.e., no EOP stage) bleaching sequences. All bleaching was completed in the water bath and followed "conventional" conditions of medium consistency, high temperature (180° F. [82.2° C.]) and short retention times. The sequences employed were Psv/Y, Psv/Y/P, Psv/Y/P/W, Psv/P, Psv/P/Y and Psv/P/Y/W; where W indicates a washing step for the aqueous pulp.

Figure 8:
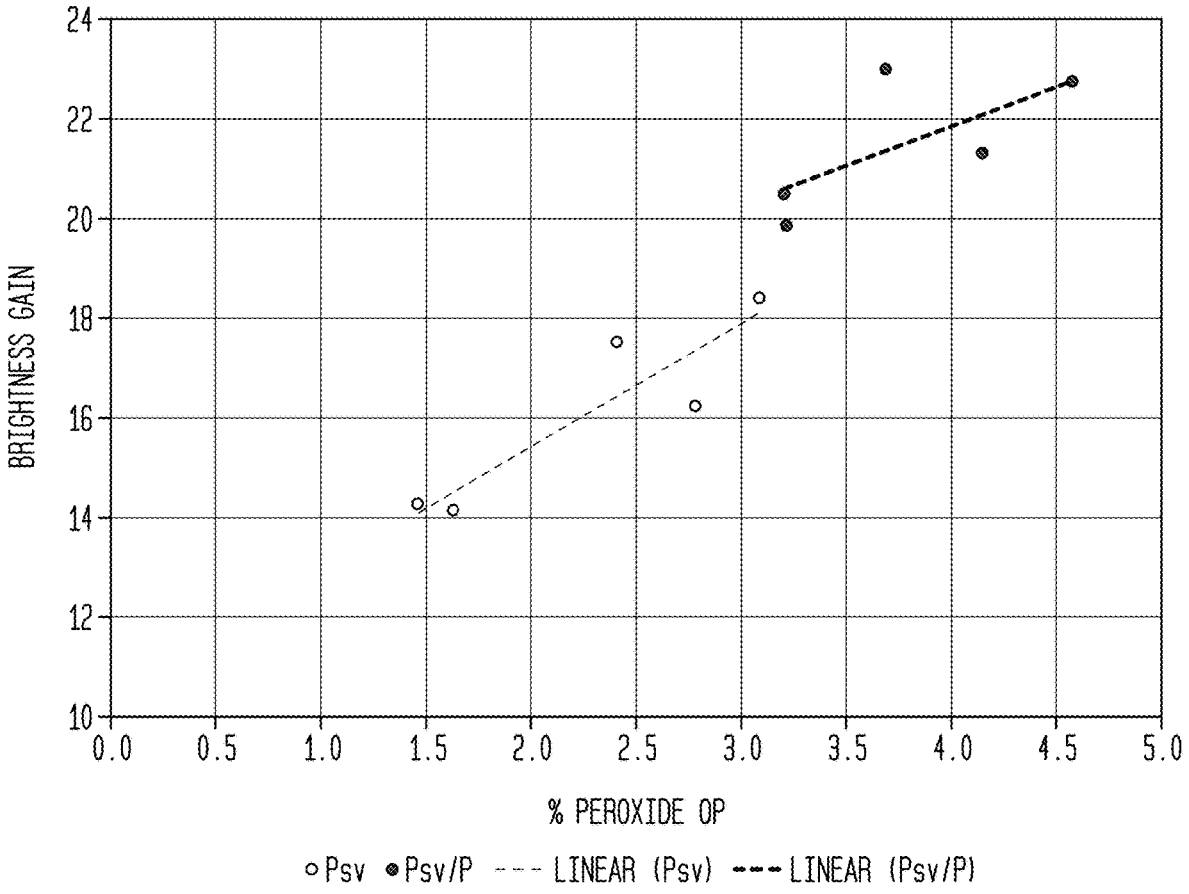
FIG. 8 is a plot of brightness versus % applied peroxide for various processes of the invention.

The first multi-stage sequence, Psv/P achieved target brightness above 80 on three out of five of the chemical doses; the 2% $H_2O_2$ samples were in the high 70's. The brightness gain and chemical dose for the Psv and Psv/P is plotted in FIG. 8. First, the data shows the relatively low peroxide consumption at the different doses—around 50 to 80% for the Psv stage. FIG. 8 shows the fairly steep brightness response curve for both peroxide stages. There is no indication of leveling off, which suggests higher gains are possible.

Overall, the curves show the higher chemical efficiency of two-stage bleaching versus a single peroxide stage.

Figure 9:
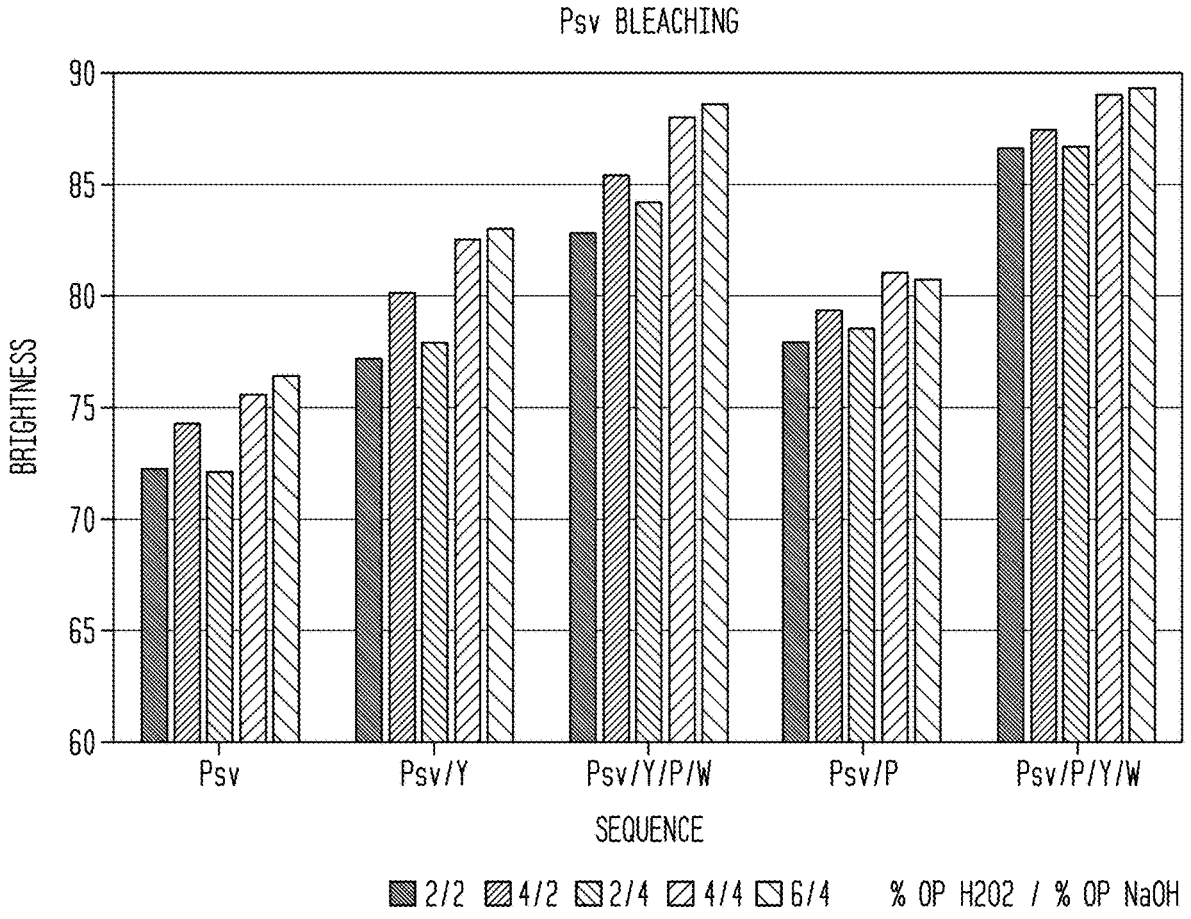
FIG. 9 is a histogram of brightness for various processes of the invention.

The pulps were bleached in a variety of sequences. FIG. 9 has a summary graph of the brightness results of this work. The Psv stage chemicals were varied but all subsequent stages utilized identical chemicals and conditions.

Using 80 brightness as our target minimum we see that three out of five chemical conditions achieved target or above with a 2-stage Psv/Y sequence. This is an extraordinary result and no other known 2-stage sequence could achieve this regardless of the chemical application. It should also be emphasized that none of the sequences utilized an oxygen stage but all achieved decolorization of the brown fiber. The next sequence was Psv/Y/P and all samples exceeded the brightness target. The Psv/Y/P/W sample adds the final wash to the bleaching stage and shows an average brightness of about 85.

The remaining sequences simulated a low cost capital upgrade to existing P/Y systems. Psv/P achieved the brightness target on the two highest chemical doses while Psv/P/Y exceeded the target on every cell. Adding the final wash increased the average brightness to 88. With a 53 start brightness for the wastepaper this gives a 35 point brightness increase which is remarkable. Incorporating a Psv stage in an existing two-stage system has the potential to allow 20-30% or more mixed paper substitution.

Another purpose for this set of experiments was to explore the differences between the Psv/Y/P sequence and the Psv/P/Y sequence. The chemistry of bleaching and decolorization indicates that it is always best practice to use the reductive stage last. The simplest explanation is that some reductively decolorized chromophores will recolor if oxidized. Peroxide decolorized chromophores will not recolor when reduced. Results show that brightness gap and the reductive stage last is the most preferred sequence; however, a Psv stage is also incorporated into an existing Y/P process to great advantage with minimal capital investment as hereinafter described in connection with FIGS. 12A and 12B.

Psv Reaction Curve and Efficiency

A large sample of the 80/20 SOP/mixed pulp was prepared and split into three samples. Psv bleaching was set up for the three samples with a 6 hour delay between samples. This allowed hourly testing for 24 hours. The brightness, pH and residual $H_2O_2$ were measured every hour. Additionally some samples were retained at temperature for 90 hours and then tested. The bleaching conditions were 2% OP $H_2O_2$, 2% OP NaOH and 0.5% OP Sodium Silicate. The retention temperature was 125° F.

Details appear in Table 2.

TABLE 2

Psv Bleaching Characteristics

| | Sample Brightness | | | pH | | |
|---|---|---|---|---|---|---|
| Elapsed Time Hr | Sample 1 | Sample 2 | Sample 3 | Sample 1 | Sample 2 | Sample 3 |
| 0 | 58.1 | 58.1 | 58.1 | | | 11.2 |
| 1 | 63.4 | 63.6 | | 11.12 | 10.74 | |
| 2 | 65.9 | 66.3 | | 10.94 | 10.62 | |
| 3 | 66.8 | 67.6 | | 10.93 | 10.7 | |
| 4 | 69.3 | 68.9 | | 10.87 | 10.41 | |
| 5 | 70.3 | 70 | | 10.89 | 10.83 | |
| 6 | 70.6 | | | 10.95 | | |
| 7 | 69.8 | | | 10.95 | | |
| 8 | 71.6 | | | 10.91 | | |
| 9 | 71.5 | | | 10.87 | | |
| 10 | 72 | | 72.7 | 10.77 | | 11.11 |
| 11 | 72.6 | | | 10.78 | | |
| 12 | 72.3 | | 72.4 | 10.7 | | 11.1 |
| 13 | | | 73.3 | | | 11.03 |
| 14 | | | 73.4 | | | 11.04 |
| 15 | | | 73.5 | | | 10.98 |
| 16 | | 73.4 | | | 11.17 | |
| 17 | | 73 | | | 11.03 | |
| 18 | | 73.6 | | | 11.01 | |
| 19 | | | | | | |
| 20 | | | | | | |
| 21 | | | | | | |
| 22 | | | | | | |
| 23 | 72.9 | | | 11.06 | | |
| 24 | 73 | | | 11.03 | | |
| 90 | | | 72.1 | | | |

Figure 10:
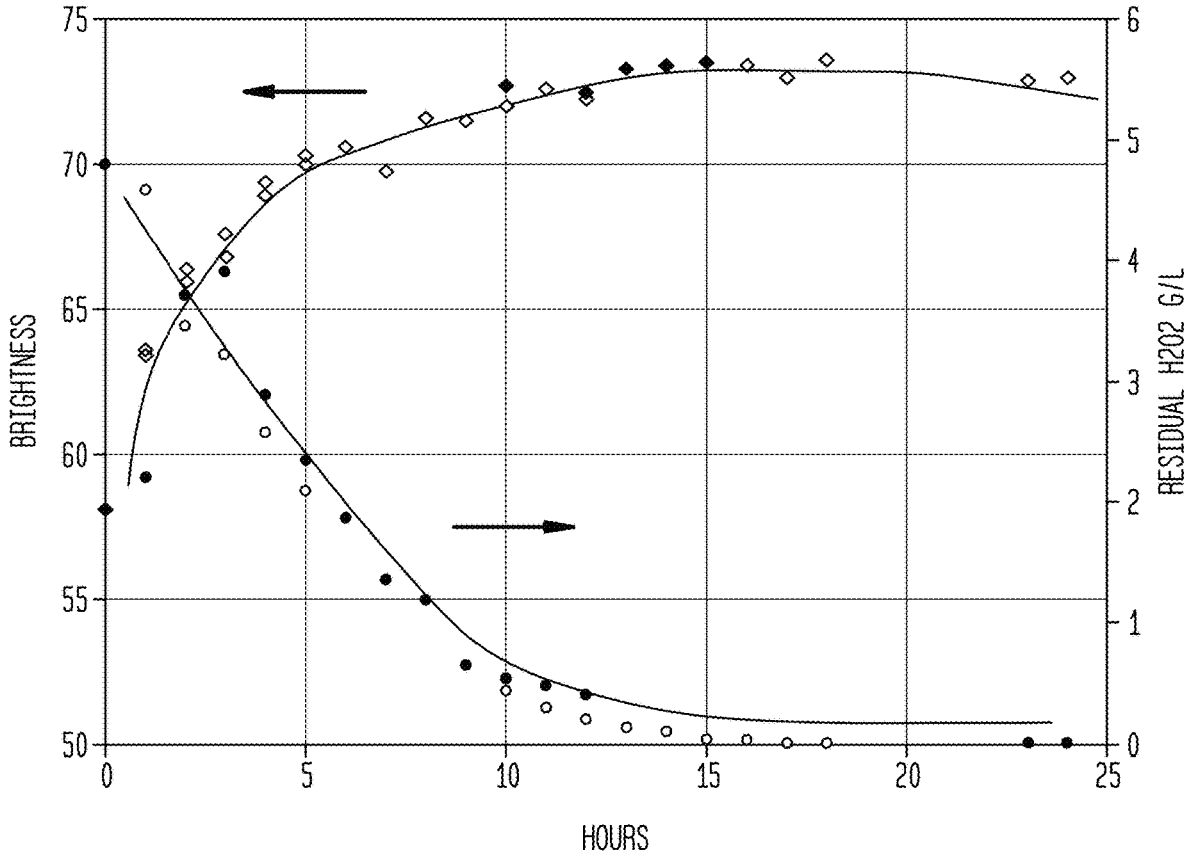
FIG. 10 is a plot of brightness and residual peroxide for the low temperature, extended duration bleaching process of the present invention.

The brightness and peroxide residual curves are given in FIG. 10. The curves do not support a simple first order reaction where the brightness is a log linear function of the peroxide consumption. It appears the brightness levels off around 12 hours. However, the curve also shows the brightness levels off as the peroxide consumption approaches 90% or so, suggesting that more peroxide could have resulted in a higher gain. The efficiency of each bleaching reaction was calculated for the conventional bleaches and for the Psv bleaches at 24 hours. Efficiency is represented by the formula:

Efficiency=Brightness Gain/Hydrogen Peroxide % OP Consumed

The graph of efficiency is given in FIG. 3 and compared to a conventional P stage. The data clearly shows the new process achieves a higher efficiency than the conventional process. FIG. 3 also shows the higher efficiency is achieved at lower temperature and lower hydrogen peroxide dose.

Color Removal

Figure 11A:
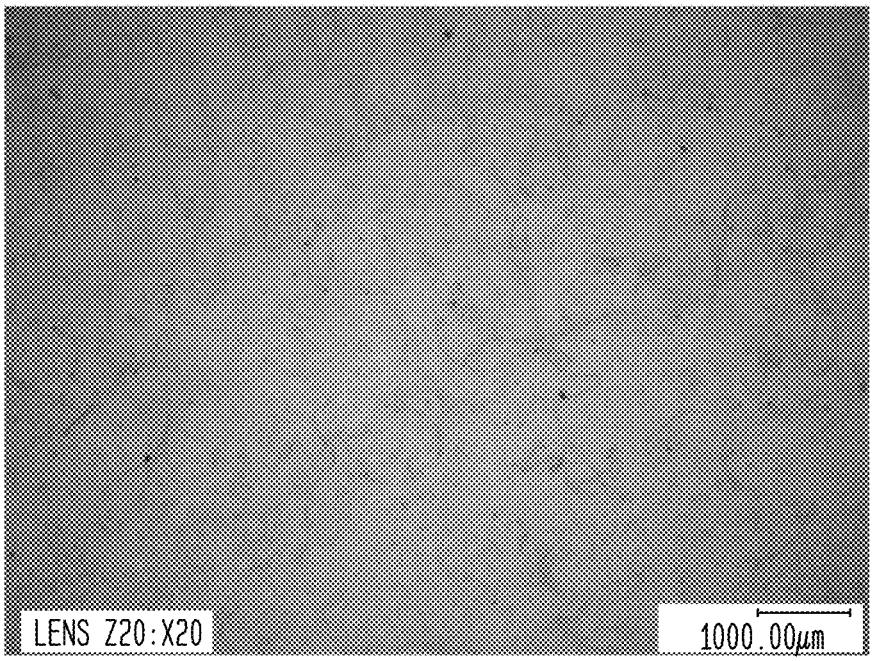
FIG. 11A is a photograph of a handsheet made with low brightness recycle pulp with brown color fibers prior to bleaching.
Figure 11B:
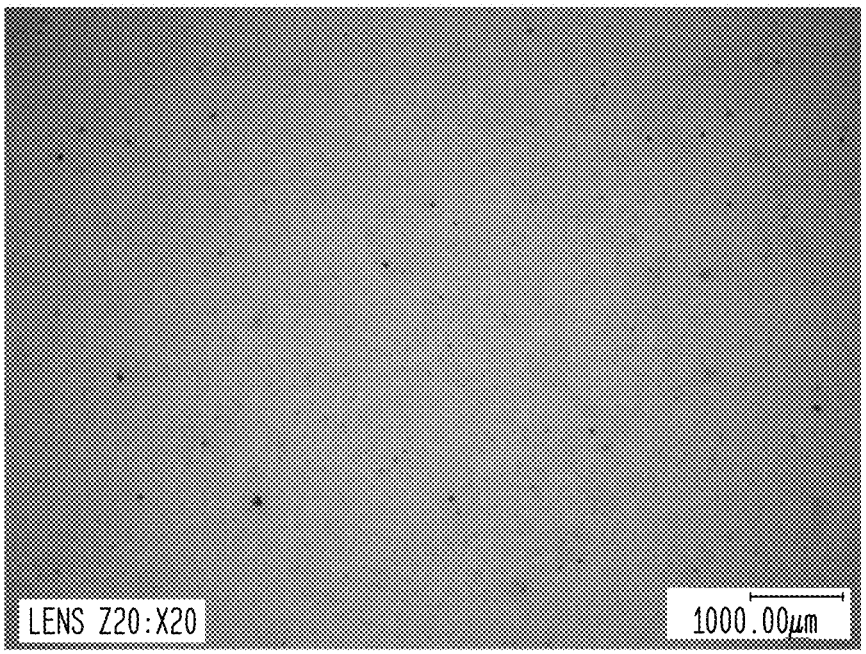
FIG. 11B is a photograph of a handsheet made with low brightness recycle pulp after 4 hours of low temperature bleaching in accordance with the invention, where it is seen the brown color fibers have been bleached to high brightness.

A visual examination of the handsheets shows the unexpected decolorization of the brown fibers over the course of the first 4 hours of retention. FIG. 11A shows 20× photomicrographs of the start handsheet and FIG. 11B shows a 4 hour handsheet. The sheets clearly show the decolorization during the first few hours; after only 4 hours of retention most of the color has been removed from the brown fibers.

In order to try and understand this unexpected result Kappa numbers were tested for the bleaching curve. Table 3 has the Kappa results.

TABLE 3

Kappa Results

| Hours | Kappa | Brightness |
|---|---|---|
| 0 | 15.9 | 58.1 |
| 12 | 12.1 | 72.3 |
| 15 | 11.6 | 73.5 |
| 18 | 11.5 | 73.6 |
| 24 | 11.2 | 73 |
| 90 | 11.2 | 72.1 |

From Table 3 we see the initial Kappa was reduced only about 24% in the first 12 hours of retention. Using this Kappa reduction and the known OCC content a calculation was made of the potential Kappa reduction of the OCC—assuming it was responsible for the decrease. Details appear in Table 4.

TABLE 4

Kappa Contributions of Fiber

| | OCC | Other fiber | Kappa |
|---|---|---|---|
| Start Kappa | 80 | 5 | 15.9 |
| % in Mix | 15% | 85% | |
| Kappa Contribution | 11.6 | 4.3 | 15.9 |
| Final Kappa | 47.7 | 5 | 11.2 |
| % in Mix | 15% | 85% | |
| Kappa Contribution | 6.9 | 4.3 | 11.2 |

Using a start OCC of 80 Kappa (typical), the calculation shows a minimum OCC Kappa reduction to 48 Kappa to account for the final sample Kappa. Absent significant decolorization of the lignin a 48 Kappa OCC would still have a significant brown tinge.

Summary of Multi-Stage Bleaching Performance

Selected Psv samples, 12-90 hours of retention time, were washed and subjected to a second and third bleaching stage. This series of trials was to determine if the Psv retention had any negative effect on the final brightness in a commercial system. FIG. 2 shows the brightness results from of the bleaching experiments.

The Psv treated pulp was run through a conventional peroxide stage with a 1% OP hydrogen peroxide dose. All samples were about a 76 brightness with no impact from Psv retention time. The 18 hour sample was also bleached with 3% OP $H_2O_2$ and showed only about a 3 point higher brightness.

Next, the Psv pulps were reductive bleached. Again, there was no impact from retention seen with all samples getting about 82 brightness; above our 80 target with only 2-stage bleaching. The Psv/P samples averaged 84 brightness after the reductive stage. Finally the 3% P sample was reductively bleached and hit 86 brightness.

Integration into Existing Bleaching Plant

Figure 12A:
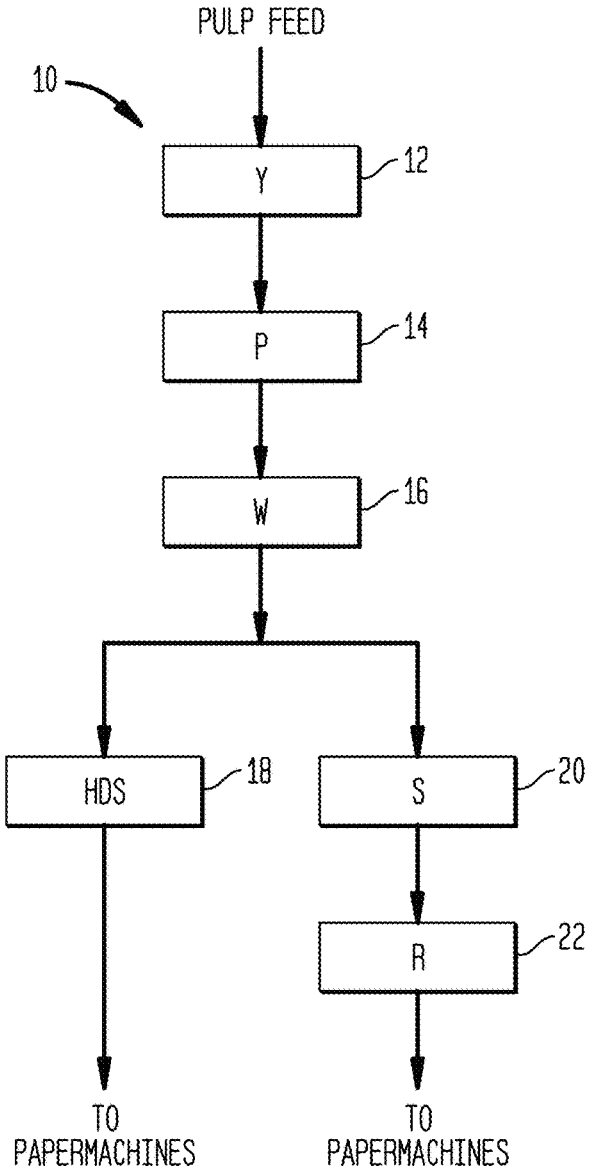
FIGS. 12A and 12B are respectively schematic illustrations of a conventional bleaching process, configuration (A) and a modified bleaching process configuration in accordance with the invention (B).
Figure 12B:
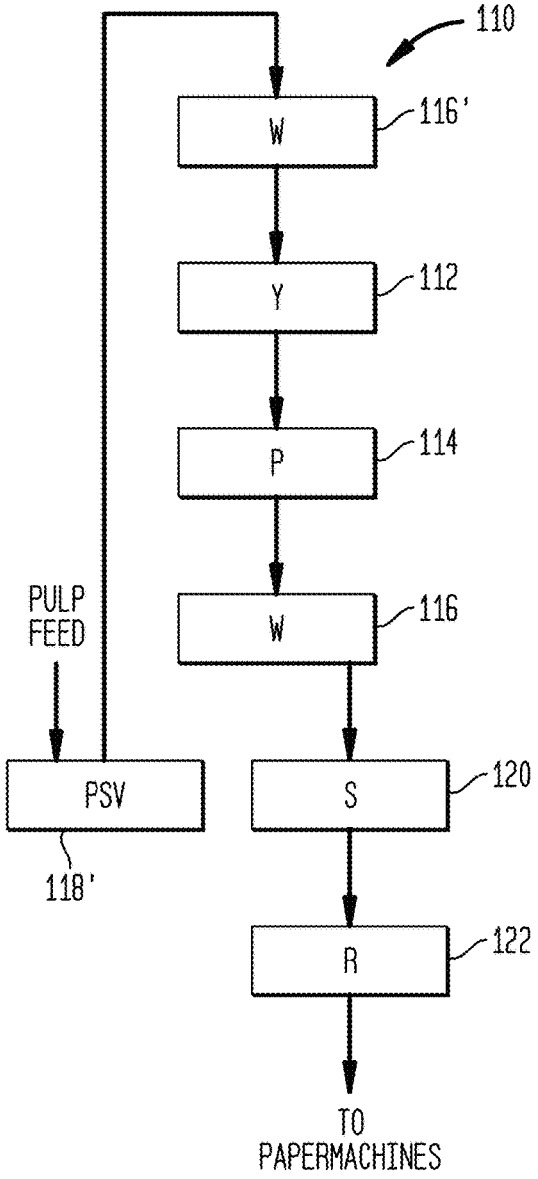

The bleaching method of the present invention is readily integrated into an existing multi-stage bleaching plant at a papermill as is appreciated from FIGS. 12A and 12B. In FIG. 12A there is shown schematically a simplified version of an existing Y/P bleaching plant 10. A pulp feed is provided to a first Y bleaching stage 12, bleached and provided to a second P stage 14, followed by washing at 16. The washed pulp is then provided to a high density storage tower 18 or a wet lap storage system 20. Tower 18 may have a storage capacity of 200-400 metric tons of dried pulp at a consistency of 15 to 20 percent. Bleached pulp is provided from tower 18 to papermachines, as required. Bleached pulp from storage system 20 may also be repulped at 22 and fed to the papermachines, as needed.

System 10 is readily modified to incorporate a PsV stage as shown in FIG. 12B wherein like components are numbered 100 numerals higher. In FIG. 12B, storage tower 18 has been converted to a Psv stage 118'. Psv stage 118' receives the pulp feed, wherein the pulp is bleached and provided to an optional washing stage 116' before being fed to the modified system 110 of FIG. 12B as shown.

The original Y/P multi-stage bleaching plant is thus converted to a Psv/Y/P bleaching plant with minimal capital investment. The modified plant thus provides a method of concurrently bleaching and storing pulp for extended times, providing a supply of pulp available as needed while minimizing pulp degradation due to microbial growth. That is, there is provided a method for concurrently bleaching and storing cellulosic pulp including: (a) providing a charge of aqueous pulp to a bleaching vessel at a consistency of from 10% to 30% along with a peroxy bleaching agent and an alkaline agent effective to adjust pH of the charge to 9.5 to 12.5; and (b) bleaching the pulp in the bleaching vessel while maintaining a bleaching temperature of from 85° F. (29° C.) to 135° F. (57° C.) and a pH of the charge from 9.5 to 12.5 for a bleaching retention time as may be required to ensure an uninterrupted supply of bleached pulp to the paper mill. Moreover, the existing bleaching plant is upgraded to handle low brightness pulp including pulp with brown fibers without the need for an oxygen tower.

EXEMPLARY EMBODIMENTS

There is provided in accordance with the in invention as Embodiment No. 1, a multi-stage bleaching process for aqueous cellulosic pulp comprising:

(a) bleaching the aqueous cellulosic pulp in an extended duration bleaching stage including: (i) providing the aqueous cellulosic pulp to the extended duration bleaching stage at a consistency of from 10% to 30% along with a peroxy bleaching agent and an alkaline agent effective to adjust pH of the charge to 9.5 to 12.5; (ii) bleaching the pulp in the bleaching vessel while maintaining an extended duration bleaching temperature of from 110° F. (43° C.), to 135° F. (57° C.) and a pH of the charge from 9.5 to 12.5 for a bleaching retention time in the extended duration bleaching stage of from 6 to 90 hours; and (b) bleaching the aqueous cellulosic pulp in one or more bleaching stages of lesser duration with bleaching agent for a retention time of from 5 minutes to 3.5 hours while maintaining a lesser duration bleaching temperature of from 122° F. (50° C.) to 230° F. (110° C.).

Embodiment No. 2 is the process according to Embodiment No. 1, wherein the extended duration bleaching stage precedes the one or more bleaching stages of lesser duration.

Embodiment No. 3 is the process according to Embodiment Nos. 1 or 2, wherein the aqueous cellulosic pulp is washed between bleaching stages.

Embodiment No. 4 is the process according to any one of Embodiment Nos. 1 to 3, wherein the peroxy bleaching agent is selected from hydrogen peroxide, peroxyacetic acid, peroxy formic acid, potassium peroxymonosulfate, dimethyldioxirane and peroxymonophosphoric acid.

Embodiment No. 5 is the process according to any one of Embodiment Nos. 1 to 4, wherein the extended duration bleaching temperature is from 118.4° F. (48° C.) to 131° F. (55° C.).

Embodiment No. 6 is the process according to any one of Embodiment Nos. 1 to 5, wherein the retention time in the extended duration bleaching stage is from 10 hours to 20 hours.

Embodiment No. 7 is the process according to any one of Embodiment Nos. 1 to 6, wherein the extended duration bleaching stage is carried out at a pH of from 10 to 11.

Embodiment No. 8 is the process according to any one of Embodiment Nos. 1 to 7, wherein the aqueous pulp is provided to the extended duration bleaching stage at a consistency of from 12.5% to 17.5%.

Embodiment No. 9 is the process according to any one of Embodiment Nos. 1 to 7, wherein the extended duration bleaching stage is carried out with a peroxy bleaching agent applied to the cellulosic pulp in an amount of from 0.1 kg-moles bleaching agent/metric ton of dried pulp to 2.4 kg-moles bleaching agent/metric ton of dried pulp.

Embodiment No. 10 is the process according to Embodiment No. 9, wherein the extended duration bleaching stage is carried out with a peroxy bleaching agent applied to the cellulosic pulp in an amount of from 0.15 kg-moles bleaching agent/metric ton of dried pulp to 2 kg-moles bleaching agent/metric ton of dried pulp.

Embodiment No. 11 is the process according to Embodiment No. 9, wherein the extended duration bleaching stage is carried out with a peroxy bleaching agent applied to the cellulosic pulp in an amount of from 0.2 kg-moles bleaching agent/metric ton of dried pulp to 1.5 kg-moles bleaching agent/metric ton of dried pulp.

Embodiment No. 12 is the process according to Embodiment No. 9, wherein the extended duration bleaching stage is carried out with a peroxy bleaching agent applied to the cellulosic pulp in an amount of from 0.2 kg-moles bleaching agent/metric ton of dried pulp to 1 kg-moles bleaching agent/metric ton of dried pulp.

Embodiment No. 13 is the process according to Embodiment No. 9, wherein the extended duration bleaching stage is carried out with a peroxy bleaching agent applied to the cellulosic pulp in an amount of from 0.5 kg-moles bleaching agent/metric ton of dried pulp to 2 kg-moles bleaching agent/metric ton of dried pulp.

Embodiment No. 14 is the process according to Embodiment No. 9, wherein the extended duration bleaching stage is carried out with a peroxy bleaching agent applied to the cellulosic pulp in an amount of from 0.885 kg-moles bleaching agent/metric ton of dried pulp to 1.8 kg-moles bleaching agent/metric ton of dried pulp.

Embodiment No. 15 is the process according to any one of Embodiment Nos. 1 to 8, wherein the peroxy bleaching agent utilized in the extended duration bleaching stage is hydrogen peroxide applied to the fiber in an amount of from 0.35% on dried pulp to 8% on dried pulp.

Embodiment No. 16 is the process according to Embodiment No. 15, wherein the peroxy bleaching agent utilized in the extended duration bleaching stage is hydrogen peroxide applied to the fiber in an amount of from 0.35% on dried pulp to 6% on dried pulp.

Embodiment No. 17 is the process according to Embodiment No. 15, wherein the peroxy bleaching agent utilized in the extended duration bleaching stage is hydrogen peroxide applied to the fiber in an amount of from 0.35% on dried pulp to 4% on dried pulp.

Embodiment No. 18 is the process according to Embodiment No. 15, wherein the peroxy bleaching agent utilized in the extended duration bleaching stage is hydrogen peroxide applied to the fiber in an amount of from 2% on dried pulp to 7% on dried pulp.

Embodiment No. 19 is the process according to Embodiment No. 15, wherein the peroxy bleaching agent utilized in the extended duration bleaching stage is hydrogen peroxide applied to the fiber in an amount of from 3% on dried pulp to 6% on dried pulp.

Embodiment No. 20 is the process according to Embodiment No. 15, wherein the peroxy bleaching agent utilized in the extended duration bleaching stage is hydrogen peroxide applied to the fiber in an amount of from 4% on dried pulp to 5% on dried pulp.

Embodiment No. 21 is the process according to any one of Embodiment Nos. 1 to 20, wherein the one or more bleaching stages of lesser duration are carried out for a retention time of from 5 minutes to 2.5 hours.

Embodiment No. 22 is the process according to Embodiment No. 21, wherein the one or more bleaching stages of lesser duration are carried out for a retention time of from 15 minutes to 1 hour.

Embodiment No. 23 is the process according to any of Embodiment Nos. 1 to 22, wherein the one or more bleaching stages of lesser duration are carried out while maintaining a lesser duration bleaching temperature of from 149° F. (65° C.) to 203° F. (95° C.).

Embodiment No. 24 is the process according to any one of Embodiment Nos. 1 to 23, wherein the one or more bleaching stages of lesser duration includes a reductive bleaching stage with a reductive bleaching agent.

Embodiment No. 25 is the process according to Embodiment No. 24, wherein the one or more bleaching stages of lesser duration includes a reductive bleaching stage with a reductive bleaching agent selected from hydrosulfite bleaching agents, formamidine sulfinic acid and hydroxymethane sulfinic acid.

Embodiment No. 26 is the process according to Embodiment No. 24, wherein the one or more bleaching stages of lesser duration includes a reductive bleaching stage with a hydrosulfite bleaching agent.

Embodiment No. 27 is the process according to any one of Embodiment Nos. 1 to 26, wherein the one or more bleaching stages of lesser duration includes a bleaching stage with oxygen as a bleaching agent.

Embodiment No. 28 is the process according to Embodiment No. 27, wherein oxygen bleaching is carried out at an oxygen pressure of from 0.25 MPa to 1 MPa.

Embodiment No. 29 is the process according to Embodiment Nos. 27 or 28, wherein the bleaching stage of lesser duration with oxygen as a bleaching agent further comprises a peroxy compound as a bleaching agent.

Embodiment No. 30 is the process according to any of Embodiment Nos. 1 to 29, wherein the one or more bleaching stages of lesser duration includes a bleaching stage with a peroxy bleaching agent.

Embodiment No. 31 is the process according to Embodiment No. 1, wherein the bleaching process includes sequentially:

(a) bleaching the aqueous cellulosic pulp in the extended duration bleaching stage; followed by (b) washing the aqueous cellulosic pulp; followed by (c) bleaching the aqueous pulp in a reductive bleaching stage of lesser duration with a reductive bleaching agent, wherein the extended duration bleaching stage optionally includes any of the further features of Embodiments 5 to 20 and the bleaching stage of lesser duration optionally includes any of the further features of Embodiments 21 to 23 and Embodiments 25 or 26.

Embodiment No. 32 is the process according to Embodiment No. 1, wherein the bleaching process includes sequentially:

(a) bleaching the aqueous cellulosic pulp in the extended duration bleaching stage; followed by (b) washing the aqueous cellulosic pulp; followed by (c) bleaching the washed cellulosic pulp in a peroxy bleaching stage of lesser duration with a peroxy bleaching agent; followed by (d) washing the aqueous cellulosic pulp; followed by (e) bleaching the aqueous pulp in a reductive bleaching stage of lesser duration with a reductive bleaching agent, wherein the extended duration bleaching stage optionally includes any of the further features of Embodiments 5 to 20 and the bleaching stages of lesser duration optionally include any of the further features of Embodiments 21 to 23 and Embodiments 25 or 26.

Embodiment No. 33 is the process according to Embodiment No. 1, wherein the bleaching process includes sequentially:

(a) bleaching the aqueous cellulosic pulp in the extended duration bleaching stage; followed by (b) optionally washing the aqueous cellulosic pulp; followed by (c) bleaching the aqueous pulp in a reductive bleaching stage of lesser duration with a reductive bleaching agent; followed by (d) bleaching the aqueous cellulosic pulp in a peroxy bleaching stage of lesser duration with a peroxy bleaching agent, wherein the extended duration bleaching stage optionally includes any of the further features of Embodiments 5 to 20 and the bleaching stages of lesser duration optionally include any of the further features of Embodiments 21 to 23 and Embodiments 25 or 26.

Embodiment No. 34 is the process according to any of Embodiment Nos. 1 to 33, wherein cellulosic pulp is recycle pulp having an ISO brightness of from 40 to 65 prior to bleaching.

Embodiment No. 35 is the process according to any of Embodiment Nos. 1 to 34, wherein cellulosic pulp is recycle pulp having an ISO brightness of from 50 to 60 prior to bleaching.

Embodiment No. 36 is a bleached pulp prepared according to any of Embodiment Nos. 1 to 35.

Embodiment No. 37 is a high efficiency bleaching method for cellulosic pulp comprising:

(a) providing a charge of aqueous cellulosic pulp to a bleaching vessel at a consistency of from 10% to 30% along with a peroxy bleaching agent and an alkaline agent effective to adjust pH of the charge to 9.5 to 12.5; and (b) bleaching the aqueous cellulosic pulp in the bleaching vessel while maintaining a bleaching temperature of from 110° F. (43° C.) to 135° F. (57° C.) and a pH of the charge from 9.5 to 12.5 for a bleaching retention time of from 6 to 90 hours such that from 0.1 kg-moles bleaching agent/metric ton of dried pulp to 2.4 kg-moles bleaching agent/metric ton of dried pulp are consumed in bleaching the aqueous cellulosic pulp.

Embodiment No. 38 is the high efficiency bleaching method according to Embodiment No. 37, wherein the peroxy bleaching agent is selected from hydrogen peroxide, peroxyacetic acid, peroxy formic acid, potassium peroxymonosulfate, dimethyldioxirane and peroxymonophosphoric acid.

Embodiment No. 39 is the high efficiency bleaching method according to Embodiment Nos. 37 or 38, wherein the bleaching temperature is from 118.4° F. (48° C.) to 131° F. (55° C.).

Embodiment No. 40 is the high efficiency bleaching method according to any of Embodiment Nos. 37 to 39, wherein the retention time in the bleaching vessel during bleaching is from 10 hours to 20 hours.

Embodiment No. 41 is the high efficiency bleaching method according to any of Embodiment Nos. 37 to 40, wherein the bleaching is carried out at a pH of from 10 to 11.

Embodiment No. 42 is the high efficiency bleaching method according to any of Embodiment Nos. 37 to 41, wherein the aqueous pulp is provided to the bleaching vessel at a consistency of from 12.5% to 17.5%.

Embodiment No. 43 is the high efficiency bleaching method according to any of Embodiment Nos. 37 to 42, wherein the bleaching is carried out with a peroxy bleaching agent applied to the cellulosic pulp such that from 0.15 kg-moles bleaching agent/metric ton of dried pulp to 2 kg-moles bleaching agent/metric ton of dried pulp are consumed in bleaching the aqueous pulp.

Embodiment No. 44 is the high efficiency bleaching method according to any of Embodiment Nos. 37 to 43, wherein the bleaching is carried out with a peroxy bleaching agent applied to the cellulosic pulp such that from 0.2 kg-moles bleaching agent/metric ton of dried pulp to 1.5 kg-moles bleaching agent/metric ton of dried pulp are consumed in bleaching the aqueous pulp.

Embodiment No. 45 is the high efficiency bleaching method according to any of Embodiment Nos. 37 to 44, wherein the bleaching is carried out with a peroxy bleaching agent applied to the cellulosic pulp such that from 0.2 kg-moles bleaching agent/metric ton of dried pulp to 1 kg-moles bleaching agent/metric ton of dried pulp are consumed in bleaching the aqueous pulp.

Embodiment No. 46 is the high efficiency bleaching method according to any of Embodiment Nos. 37 to 45, wherein the bleaching is carried out with a peroxy bleaching agent applied to the cellulosic pulp such that from 0.25 kg-moles bleaching agent/metric ton of dried pulp to 0.65 kg-moles bleaching agent/metric ton of dried pulp are consumed in bleaching the aqueous pulp.

Embodiment No. 47 is the high efficiency bleaching method according to any of Embodiment Nos. 37 to 42, wherein the peroxy bleaching agent utilized in the bleaching is hydrogen peroxide applied to the fiber such that from 0.35% hydrogen peroxide on dried pulp to 8% hydrogen peroxide on dried pulp are consumed in bleaching the aqueous pulp.

Embodiment No. 48 is the high efficiency bleaching method according to Embodiment No. 47, wherein the peroxy bleaching agent utilized in the bleaching is hydrogen peroxide applied to the fiber such that from 0.35% hydrogen peroxide on dried pulp to 6% hydrogen peroxide on dried pulp are consumed in bleaching the aqueous pulp.

Embodiment No. 49 is the high efficiency bleaching method according to Embodiment No. 47, wherein the peroxy bleaching agent utilized in the bleaching is hydrogen peroxide applied to the fiber such that from 0.35% hydrogen peroxide on dried pulp to 4% hydrogen peroxide on dried pulp are consumed in bleaching the aqueous pulp.

Embodiment No. 50 is the high efficiency bleaching method according to Embodiment No. 47, wherein the peroxy bleaching agent utilized in the bleaching is hydrogen peroxide applied to the fiber such that from 0.35% hydrogen peroxide on dried pulp to 3% hydrogen peroxide on dried pulp are consumed in bleaching the aqueous pulp.

Embodiment No. 51 is the high efficiency bleaching method according to Embodiment No. 47, wherein the peroxy bleaching agent utilized in bleaching is hydrogen peroxide applied to the fiber such that from 0.5% hydrogen peroxide on dried pulp to 2.75% hydrogen peroxide on dried pulp are consumed in bleaching the aqueous pulp.

Embodiment No. 52 is the high efficiency bleaching method according to Embodiment No. 47, wherein the peroxy bleaching agent utilized in bleaching is hydrogen peroxide applied to the fiber such that from 0.5% hydrogen peroxide on dried pulp to 2.5% hydrogen peroxide on dried pulp are consumed in bleaching the aqueous pulp.

Embodiment No. 53 is the high efficiency bleaching method according to Embodiment No. 47, wherein the peroxy bleaching agent utilized in bleaching is hydrogen peroxide applied to the fiber such that from 0.5% hydrogen peroxide on dried pulp to 2% hydrogen peroxide on dried pulp are consumed in bleaching the aqueous pulp.

Embodiment No. 54 is the high efficiency bleaching method according to any of Embodiment Nos. 37 to 53, wherein the aqueous cellulosic pulp is recycle pulp having an ISO brightness of from 40 to 65 prior to bleaching.

Embodiment No. 55 is the high efficiency bleaching method according to any of Embodiment Nos. 37 to 54, wherein the aqueous cellulosic pulp is recycle pulp having an ISO brightness of from 50 to 60 prior to bleaching.

Embodiment No. 56 is a bleached pulp prepared according to any of Embodiment Nos. 37 to 55.

Embodiment No. 57 is the high efficiency bleaching method for recycled cellulosic pulp comprising:

(a) providing a charge of aqueous recycled cellulosic pulp to a bleaching vessel at a consistency of from 10% to 30% along with a peroxy bleaching agent and an alkaline agent effective to adjust pH of the charge to 9.5 to 12.5; and (b) bleaching the aqueous cellulosic pulp in the bleaching vessel while maintaining a bleaching temperature of from 110° F. (43° C.) to 135° F. (57° C.) and a pH of the charge from 9.5 to 12.5 for a bleaching retention time of from 6 to 90 hours;

wherein the temperature, retention time, peroxy and alkaline agent levels are controlled such that the brightness gain is at least 8 ISO brightness points/0.295 kg-moles peroxy bleaching agent consumed per dried metric ton of pulp.

Embodiment No. 58 is the high efficiency bleaching method for recycled cellulosic pulp according to Embodiment No. 57, wherein the aqueous cellulosic pulp is recycle pulp having an ISO brightness of from 40 to 65 prior to bleaching.

Embodiment No. 59 is the high efficiency bleaching method for recycled cellulosic pulp according to Embodiment Nos. 57 or 58, wherein the aqueous cellulosic pulp is recycle pulp having an ISO brightness of from 50 to 60 prior to bleaching.

Embodiment No. 60 is the high efficiency bleaching method for recycled cellulosic pulp according to any of Embodiment Nos. 57 to 59, wherein the peroxy bleaching agent is selected from hydrogen peroxide, peroxyacetic acid, peroxy formic acid, potassium peroxymonosulfate, dimethyldioxirane and peroxymonophosphoric acid.

Embodiment No. 61 is the high efficiency bleaching method for recycled cellulosic pulp according to any of Embodiment Nos. 57 to 60, wherein the bleaching temperature is from 118.4° F. (48° C.) to 131° F. (55° C.).

Embodiment No. 62 is the high efficiency bleaching method for recycled cellulosic pulp according to any of Embodiment Nos. 57 to 61, wherein the retention time in the extended duration bleaching stage is from 10 hours to 20 hours.

Embodiment No. 63 is the high efficiency bleaching method for recycled cellulosic pulp according to any of Embodiment Nos. 57 to 62, wherein bleaching is carried out at a pH of from 10 to 11.

Embodiment No. 64 is the high efficiency bleaching method for recycled cellulosic pulp according to any of Embodiment Nos. 57 to 63, wherein the aqueous pulp is provided to the bleaching vessel at a consistency of from 12.5% to 17.5%.

Embodiment No. 65 is the high efficiency bleaching method for recycled cellulosic pulp according to any of Embodiment Nos. 57 to 64, wherein the temperature, retention time, peroxy and alkaline agent levels are controlled such that the brightness gain is at least 10 ISO brightness points per 0.295 kg-moles peroxy bleaching agent consumed per dried metric ton of pulp.

Embodiment No. 66 is the high efficiency bleaching method for recycled cellulosic pulp according to any of Embodiment Nos. 57 to 65, wherein the temperature, retention time, peroxy and alkaline agent levels are controlled such that the brightness gain is at least 12 ISO brightness points per 0.295 kg-moles peroxy bleaching agent consumed per dried metric ton of pulp.

Embodiment No. 67 is the high efficiency bleaching method for recycled cellulosic pulp according to any of Embodiment Nos. 57 to 66, wherein the peroxy bleaching agent utilized in the bleaching is hydrogen peroxide applied to the fiber in an amount of from 0.35% to 8% on dried pulp.

Embodiment No. 68 is the high efficiency bleaching method for recycled cellulosic pulp according to Embodiment No. 67, wherein the peroxy bleaching agent utilized in the bleaching is hydrogen peroxide applied to the fiber in an amount of from 0.35% to 6% on dried pulp.

Embodiment No. 69 is the high efficiency bleaching method for recycled cellulosic pulp according to Embodiment No. 67, wherein the peroxy bleaching agent utilized in the bleaching is hydrogen peroxide applied to the fiber in an amount of from 0.35% to 4% on dried pulp.

Embodiment No. 70 is the high efficiency bleaching method for recycled cellulosic pulp according to Embodiment No. 67, wherein the peroxy bleaching agent utilized in the bleaching is hydrogen peroxide applied to the fiber in an amount of from 0.5% to 3% on dried pulp.

Embodiment No. 71 the high efficiency bleaching method for recycled cellulosic pulp according to Embodiment No. 67, wherein the peroxy bleaching agent utilized in the bleaching is hydrogen peroxide applied to the fiber in an amount of from 0.5% to 2% on dried pulp.

Embodiment No. 72 is the high efficiency bleaching method for recycled cellulosic pulp according to any of Embodiment Nos. 57 to 71, wherein the temperature, retention time, peroxy and alkaline agent levels are controlled such that the brightness gain is at least 8 ISO brightness points per 1% hydrogen peroxide on dried pulp consumed during bleaching.

Embodiment No. 73 is the high efficiency bleaching method for recycled cellulosic pulp according to Embodiment No. 72, wherein the temperature, retention time, peroxy and alkaline agent levels are controlled such that the brightness gain is from 8 to 14 ISO brightness points per 1% hydrogen peroxide on dried pulp consumed during bleaching.

Embodiment No. 74 is a bleached pulp prepared according to any of Embodiment Nos. 57 to 73.

Embodiment No. 75 is a method for concurrently bleaching and storing cellulosic pulp comprising:

(a) providing a charge of aqueous pulp to a bleaching vessel at a consistency of from 10% to 30% along with a peroxy bleaching agent and an alkaline agent effective to adjust pH of the charge to 9.5 to 12.5; and (b) bleaching the pulp in the bleaching vessel while maintaining a bleaching temperature of from 85° F. (29° C.) to 135° F. (57° C.) and a pH of the charge from 9.5 to 12.5 for a bleaching retention time of more than 24 hours.

Embodiment No. 76 is the method for concurrently bleaching and storing aqueous cellulosic pulp according to Embodiment No. 75, wherein while maintaining a bleaching temperature of from 110° F. (43° C.) to 135° F. (57° C.) and a pH of the charge from 9.5 to 12.5 for the bleaching retention time.

Embodiment No. 77 is the method for concurrently bleaching and storing aqueous cellulosic pulp according to Embodiment Nos. 75 or 76, wherein the bleaching retention time is from more than 24 hours to 144 hours.

Embodiment No. 78 is the method for concurrently bleaching and storing aqueous cellulosic pulp according to Embodiment No. 77, wherein the bleaching retention time is from more than 24 hours to 96 hours.

Embodiment No. 79 is the method for concurrently bleaching and storing aqueous cellulosic pulp according to any of Embodiment Nos. 75 to 78, optionally including any of the further features of the extended duration bleaching stage of Embodiments 5 and 7-20.

Embodiment No. 80 is the method for concurrently bleaching and storing aqueous cellulosic pulp according to any of Embodiment Nos. 75 to 79, followed by washing the bleached aqueous cellulosic pulp.

Embodiment No. 81 is the method for concurrently bleaching and storing aqueous cellulosic pulp according to any of Embodiment Nos. 75 to 80, followed by a bleaching stage of lesser duration with a bleaching agent for a retention time of from 5 minutes to 3.5 hours while maintaining a lesser duration bleaching temperature of from 122° F. (50° C.) to 230° F. (110° C.) and optionally including any of the features of Embodiments 21 to 30.

Embodiment No. 82 is the method for concurrently bleaching and storing aqueous cellulosic pulp according to any of Embodiment Nos. 75 to 80, followed by bleaching the aqueous pulp in a reductive bleaching stage of lesser duration with a reductive bleaching agent, for a retention time of from 5 minutes to 3.5 hours while maintaining a lesser duration bleaching temperature of from 122° F. (50° C.) to 230° F. (110° C.) and optionally including any of the further features of Embodiments 21 to 23 and Embodiments 25 or 26 in the reductive bleaching stage.

Embodiment No. 83 is the method for concurrently bleaching and storing aqueous cellulosic pulp according to Embodiment No. 80, followed by (a) bleaching the washed cellulosic pulp in a peroxy bleaching stage of lesser duration with a peroxy bleaching agent; followed by (b) washing the aqueous cellulosic pulp; followed by (c) bleaching the aqueous pulp in a reductive bleaching stage of lesser duration with a reductive bleaching agent, wherein the bleaching stages of lesser duration have a retention time of from 5 minutes to 3.5 hours and are carried out while maintaining a lesser duration bleaching temperature of from 122° F. (50°

C.) to 230° F. (110° C.) and optionally include any of the further features of Embodiments 21 to 23 and Embodiments 25 or 26.

Embodiment No. 84 is the method for concurrently bleaching and storing aqueous cellulosic pulp according to any of Embodiment Nos. 75 to 80, followed by (a) bleaching the aqueous pulp in a reductive bleaching stage of lesser duration with a reductive bleaching agent; followed by (b) bleaching the aqueous cellulosic pulp in a peroxy bleaching stage of lesser duration with a peroxy bleaching agent; wherein the bleaching stages of lesser duration have a retention time of from 5 minutes to 3.5 hours and are carried out while maintaining a lesser duration bleaching temperature of from 122° F. (50° C.) to 230° F. (110° C.) and optionally include any of the further features of Embodiments 21 to 23 and Embodiments 25 or 26.

Embodiment No. 85 is the method for concurrently bleaching and storing cellulosic pulp according to any of Embodiment Nos. 75 to 84, wherein the aqueous cellulosic pulp is recycle pulp having an ISO brightness of from 40 to 65 prior to bleaching.

Embodiment No. 86 is the method for concurrently bleaching and storing cellulosic pulp according to Embodiment No. 85, wherein the aqueous cellulosic pulp is recycle pulp having an ISO brightness of from 50 to 60 prior to bleaching.

Embodiment No. 87 is the bleached pulp prepared according to any of Embodiment Nos. 75 to 86.

While the invention has been described in detail, modifications within the spirit and scope of the invention will be readily apparent to those of skill in the art. Such modifications are also to be considered as part of the present invention. In view of the foregoing discussion, relevant knowledge in the art and references discussed above in connection with the foregoing description including the Detailed Description and Background of the Invention, the disclosures of which are all incorporated herein by reference, further description is deemed unnecessary. In addition, it should be understood from the foregoing discussion that aspects of the invention and portions of various embodiments may be combined or interchanged either in whole or in part. Furthermore, those of ordinary skill in the art will appreciate that the foregoing description is by way of example only, and is not intended to limit the invention.

What is claimed is:

1. A high efficiency bleaching method for recycled cellulosic pulp comprising:

(a) providing a charge of aqueous recycled cellulosic pulp to a bleaching vessel at a consistency of from 10% to 30% along with a peroxy bleaching agent and an alkaline agent effective to adjust pH of the charge to 9.5 to 12.5; and (b) bleaching the aqueous cellulosic pulp in the bleaching vessel while maintaining a bleaching temperature of from 43° C. to 57° C. and a pH of the charge from 9.5 to 12.5 for a bleaching retention time of at least 10 hours;

wherein the temperature, retention time, peroxy and alkaline agent levels are controlled such that the brightness gain is at least 8 ISO brightness points/0.295 kg-moles peroxy bleaching agent consumed per dried metric ton of pulp and wherein the aqueous cellulosic pulp is recycle pulp having an ISO brightness of from 40 to 65 prior to bleaching;

followed by a Y bleaching stage or a P bleaching stage or both, wherein the Y stage comprises bleaching with a reductive bleaching agent, for a retention time of from 5 minutes to 3.5 hours while maintaining a bleaching temperature of from 50° C. to 110° C. and the P stage comprises bleaching with a peroxy bleaching agent, for a retention time of from 5 minutes to 3.5 hours while maintaining a bleaching temperature of from 50° C. to 110° C.

2. The high efficiency bleaching method for recycled cellulosic pulp according to claim 1, wherein the peroxy bleaching agent utilized in the bleaching of step (b) is hydrogen peroxide applied to the fiber in an amount of from 0.5% to 2% on dried pulp, wherein the temperature, retention time, hydrogen peroxide and alkaline agent levels of step (b) are controlled such that the brightness gain is at least 8 ISO brightness points per 1% hydrogen peroxide on dried pulp consumed during bleaching.

3. The high efficiency bleaching method for recycled cellulosic pulp according to claim 1, wherein the aqueous cellulosic pulp is recycle pulp having an ISO brightness of from 50 to 60 prior to bleaching.

4. The high efficiency bleaching method for recycled cellulosic pulp according to claim 1, wherein the bleaching temperature in the extended duration bleaching stage of step (b) is from 48° C. to 55° C.

5. The high efficiency bleaching method for recycled cellulosic pulp according to claim 1, wherein the retention time in the extended duration bleaching stage of step (b) is from 10 hours to 20 hours.

6. The high efficiency bleaching method for recycled cellulosic pulp according to claim 1, wherein bleaching in step (b) is carried out at a pH of from 10 to 11.

7. The high efficiency bleaching method for recycled cellulosic pulp according to claim 1, wherein the aqueous pulp is provided to the bleaching vessel at a consistency of from 12.5% to 17.5%.

8. The high efficiency bleaching method for recycled cellulosic pulp according to claim 1, wherein the temperature, retention time, peroxy and alkaline agent levels of step (b) are controlled such that the brightness gain is at least 10 ISO brightness points per 0.295 kg-moles peroxy bleaching agent consumed per dried metric ton of pulp in step (b).

9. The high efficiency bleaching method for recycled cellulosic pulp according to claim 1, wherein the temperature, retention time, peroxy and alkaline agent levels are controlled in step (b) such that the brightness gain is at least 12 ISO brightness points per 0.295 kg-moles peroxy bleaching agent consumed per dried metric ton of pulp in step (b).

10. The high efficiency bleaching method for recycled cellulosic pulp according to claim 1, wherein the peroxy bleaching agent utilized in the step (b) bleaching is hydrogen peroxide applied to the fiber in an amount of from 0.35% to 8% on dried pulp in step (b).

11. The high efficiency bleaching method for recycled cellulosic pulp according to claim 1, wherein the peroxy bleaching agent utilized in the step (b) bleaching is hydrogen peroxide applied to the fiber in an amount of from 0.35% to 6% on dried pulp in step (b).

12. The high efficiency bleaching method for recycled cellulosic pulp according to claim 1, wherein the peroxy bleaching agent utilized in the step (b) bleaching is hydrogen peroxide applied to the fiber in an amount of from 0.35% to 4% on dried pulp in step (b).

13. The high efficiency bleaching method for recycled cellulosic pulp according to claim 1, wherein the peroxy bleaching agent utilized in the step (b) bleaching is hydrogen peroxide applied to the fiber in an amount of from 0.5% to 3% on dried pulp in step (b).

14. The high efficiency bleaching method for recycled cellulosic pulp according to claim 1, wherein the peroxy bleaching agent utilized in the step (b) bleaching is hydrogen peroxide applied to the fiber in an amount of from 0.5% to 2% on dried pulp in step (b).

15. The high efficiency bleaching method for recycled cellulosic pulp according to claim 1, wherein the temperature, retention time, peroxy and alkaline agent levels of step (b) are controlled such that the brightness gain is from 8 to 14 ISO brightness points per 1% hydrogen peroxide on dried pulp consumed during bleaching in step (b).

16. A method for concurrently bleaching and storing cellulosic pulp comprising:

(a) providing a charge of aqueous pulp to a bleaching vessel at a consistency of from 10% to 30% along with a peroxy bleaching agent and an alkaline agent effective to adjust pH of the charge to 9.5 to 12.5; and (b) bleaching the pulp in the bleaching vessel while maintaining a bleaching temperature of from 29° C. to 57° C. and a pH of the charge from 9.5 to 12.5 for a bleaching retention time of more than 24 hours, wherein the aqueous cellulosic pulp is recycle pulp having an ISO brightness of from 40 to 65 prior to bleaching.

17. A method for concurrently bleaching and storing cellulosic pulp comprising:

(a) providing a charge of aqueous pulp to a bleaching vessel at a consistency of from 10% to 30% along with a peroxy bleaching agent and an alkaline agent effective to adjust pH of the charge to 9.5 to 12.5; and (b) bleaching the pulp in the bleaching vessel while maintaining a bleaching temperature of from 29° C. to 57° C. and a pH of the charge from 9.5 to 12.5 for a bleaching retention time of more than 24 hours, followed by a subsequent bleaching Protocol including one or more bleaching stages of lesser duration, the subsequent bleaching Protocol being selected from Protocols A, B or C, wherein:

Protocol A is bleaching the aqueous pulp in a reductive bleaching stage of lesser duration with a reductive bleaching agent, for a retention time of from 5 minutes to 3.5 hours while maintaining a lesser duration bleaching temperature of from 50° C. to 110° C.;

Protocol B is (i) washing the bleached aqueous cellulosic pulp followed by (ii) bleaching the washed cellulosic pulp in a peroxy bleaching stage of lesser duration with a peroxy bleaching agent followed by (iii) washing the aqueous cellulosic pulp; followed by (iv) bleaching the aqueous pulp in a reductive bleaching stage of lesser duration with a reductive bleaching agent, wherein the peroxy and reductive bleaching stages of lesser duration have a retention time of from 5 minutes to 3.5 hours and are carried out while maintaining a lesser duration bleaching temperature of from 50° C. to 110° C.; and Protocol (C) is (1) bleaching the aqueous pulp in a reductive bleaching stage of lesser duration with a reductive bleaching agent; followed by (2) bleaching the aqueous cellulosic pulp in a peroxy bleaching stage of lesser duration with a peroxy bleaching agent wherein the reductive and peroxy bleaching stages of lesser duration have a retention time of from 5 minutes to 3.5 hours and are carried out while maintaining a lesser duration bleaching temperature of from 50° C. to 110° C.

18. The method for concurrently bleaching and storing aqueous cellulosic pulp according to claim 17, wherein the subsequent bleaching protocol is Protocol A.

19. The method for concurrently bleaching and storing aqueous cellulosic pulp according to claim 17, wherein the subsequent bleaching protocol is Protocol B.

20. The method for concurrently bleaching and storing aqueous cellulosic pulp according to claim 17, wherein the subsequent bleaching protocol is Protocol C.

* * * * *